US008032369B2

(12) United States Patent
Manjunath et al.

(10) Patent No.: US 8,032,369 B2
(45) Date of Patent: Oct. 4, 2011

(54) ARBITRARY AVERAGE DATA RATES FOR VARIABLE RATE CODERS

(75) Inventors: Sharath Manjunath, San Diego, CA (US); Ananthapadmanabhan A. Kandhadai, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1130 days.

(21) Appl. No.: 11/625,788

(22) Filed: Jan. 22, 2007

(65) Prior Publication Data

US 2007/0171931 A1 Jul. 26, 2007

Related U.S. Application Data

(60) Provisional application No. 60/760,799, filed on Jan. 20, 2006, provisional application No. 60/762,010, filed on Jan. 24, 2006.

(51) Int. Cl.
*G10L 19/02* (2006.01)

(52) U.S. Cl. ..... 704/229; 370/320; 370/329; 370/332; 370/333

(58) Field of Classification Search ..... 704/229; 455/453, 450, 452.2; 370/320, 329, 332, 370/333

See application file for complete search history.

(56) References Cited

U.S. PATENT DOCUMENTS 4,901,307 A 2/1990 Gilhousen et al.
5,103,459 A 4/1992 Gilhousen et al.
5,414,796 A 5/1995 Jacobs et al.
5,495,555 A 2/1996 Swaminathan
5,727,123 A 3/1998 McDonough et al.
5,737,484 A 4/1998 Ozawa
5,784,532 A 7/1998 McDonough et al.
5,884,253 A 3/1999 Kleijn
5,911,128 A 6/1999 DeJaco
5,926,786 A 7/1999 McDonough et al.
6,012,026 A * 1/2000 Taori et al. ..... 704/229
6,167,079 A * 12/2000 Kinnunen et al. ..... 375/225
6,292,777 B1 9/2001 Inoue et al.
6,330,532 B1 * 12/2001 Manjunath et al. ..... 704/219
6,438,518 B1 8/2002 Manjunath et al.
6,449,592 B1 9/2002 Das
6,456,964 B2 9/2002 Manjunath et al.
6,463,097 B1 * 10/2002 Held et al. ..... 375/225

(Continued)

OTHER PUBLICATIONS

Edith Cohen and Hui-Ling Lou, "Multi-rate Detection for the IS-95 CDMA Forward Traffic Channels," Proc. of IEEE GLOBECOM, 1995, pp. 1789-1973.*

(Continued)

*Primary Examiner* — Richemond Dorvil
*Assistant Examiner* — Greg Borsetti
(74) *Attorney, Agent, or Firm* — Todd E. Marlette; Heejong Yoo

(57) ABSTRACT

Methods and apparatus are provided for achieving an arbitrary average data rate for a variable rate coder. One method includes selecting a set (e.g., a pair) of initial composite rates surrounding the arbitrary average data rate. A reallocation fraction is then calculated based on the initial composite rates. The reallocation fraction is used to reassign a number of frames from one component rate of an initial composite rate to another in order to achieve the arbitrary average data rate. Such a method may be configured such that selecting an initial composite rate on one side of (e.g., less than) the arbitrary average data rate implicitly selects the initial composite rate on the other side of the arbitrary average data rate.

26 Claims, 23 Drawing Sheets

U.S. PATENT DOCUMENTS

| | | | | |
|---|---|---|---|---|
| 6,463,407 | B2 | 10/2002 | Das et al. | |
| 6,475,245 | B2 | 11/2002 | Gersho et al. | |
| 6,477,502 | B1 | 11/2002 | Ananthpadmanabhan et al. | |
| 6,577,871 | B1 * | 6/2003 | Budka et al. | 455/453 |
| 6,584,438 | B1 | 6/2003 | Manjunath et al. | |
| 6,625,226 | B1 * | 9/2003 | Gersho et al. | 375/285 |
| 6,678,649 | B2 | 1/2004 | Manjunath | |
| 6,691,084 | B2 | 2/2004 | Manjunath et al. | |
| 6,735,567 | B2 | 5/2004 | Gao et al. | |
| 6,754,630 | B2 | 6/2004 | Das et al. | |
| 6,785,645 | B2 | 8/2004 | Khalil et al. | |
| 7,054,809 | B1 * | 5/2006 | Gao | 704/229 |
| 7,120,447 | B1 * | 10/2006 | Chheda et al. | 455/453 |
| 7,146,174 | B2 * | 12/2006 | Gardner et al. | 455/453 |
| 7,474,701 | B2 * | 1/2009 | Boice et al. | 375/240.26 |
| 7,542,777 | B2 * | 6/2009 | Haim | 455/522 |
| 7,613,606 | B2 | 11/2009 | Makinen | |
| 2001/0018650 | A1 | 8/2001 | DeJaco | |
| 2002/0007273 | A1 * | 1/2002 | Chen | 704/229 |
| 2002/0115443 | A1 * | 8/2002 | Freiberg et al. | 455/450 |
| 2002/0147022 | A1 * | 10/2002 | Subramanian et al. | 455/453 |
| 2003/0006916 | A1 * | 1/2003 | Takamizawa | 341/61 |
| 2003/0014242 | A1 | 1/2003 | Ananthpadmanabhan et al. | |
| 2004/0137909 | A1 * | 7/2004 | Gerogiokas et al. | 455/453 |
| 2004/0176951 | A1 * | 9/2004 | Sung et al. | 704/222 |
| 2004/0213182 | A1 * | 10/2004 | Huh et al. | 370/332 |
| 2005/0055203 | A1 * | 3/2005 | Makinen et al. | 704/229 |
| 2005/0111462 | A1 * | 5/2005 | Walton et al. | 370/395.4 |
| 2005/0265399 | A1 * | 12/2005 | El-Maleh et al. | 370/537 |
| 2005/0285764 | A1 * | 12/2005 | Bessette et al. | 341/143 |
| 2006/0212594 | A1 * | 9/2006 | Haner et al. | 709/232 |
| 2007/0192090 | A1 * | 8/2007 | Shahidi | 704/221 |
| 2008/0262850 | A1 | 10/2008 | Taleb et al. | |

OTHER PUBLICATIONS

Jean-Yves Le Boudec. "Rate adaptation, Congestion Control and Fairness: A Tutorial" Dec. 2000.*

Michael C. Recchione. "The Enhanced Variable Rate Coder: Toll Quality Speech for CDMA" 1999.*

ETSI TS 126 093 V6.0.0. "Source Controlled Rate operation" Mar. 2003.*

"Enhanced Variable Rate Codec, Speech Service Option 3 for Wideband Spread Spectrum Digital Systems", 3GPP2 C.S0014-A, Apr. 2004.*

"Enhanced Variable Rate Codec (EVRC)" 3GPP2 C.S0014-0. Dec. 1999.*

A. Das, A. DeJaco, S. Manjunath, A. Ananthapadmanabhan, J. Huang, E. Choy, "Multimode variable bit rate speech coding: an efficient paradigm for high-quality low-rate representation of speech signal," Acoustics, Speech, and Signal Processing, IEEE International Conference on, vol. 4, pp. 2307-2310, Acoustics, Speech, and Signal Processing, 1999. Pr.*

Ahmadi et al. "Wideband Speech Coding for CDMA2000@ Systems" 2003.*

Jelinek et al. "On the Architecture of the CDMA2000® Variable-Rate Multimode Wideband (VMR-WB) Speech Coding Standard" 2004.*

Kumar et al. "High Data-Rate Packet Communications for Cellular Networks Using CDMA: Algorithms and Performance" 1999.*

George et al. "Variable Frame Rate parameter Encoding via Adaptive Frame Selection using Dynamic Programming" 1996.*

El-Ramly et al. "A Rate-Determination Algorithm for Variable-Rate Speech Coder" 2004.*

Chawla et al. "QOS Based Scheduling for Incorporating Variable Rate Coded Voice in BLUETOOTH" 2001.*

Akhaven et al. "QoS Provisioning for Wireless ATM by Variable-Rate Coding" 1999.*

Eleftheriadis et al. "Meeting Arbitrary QoS Constraints Using Dynamic Rate Shaping of Coded Digital Video" 1995.*

Greer, S. Craig, Standardization of the Selectable Mode Vocoder, IEEE Acoustics, Speech, and Signal Processing, 2001, 0-7803-7041-4/01, pp. 953-956.

W. Bastiaan Kleijn & Wolfgang Granzow, Methods for Waveform Interpolation in Speech Coding, Digital Signal Processing 1, 1991, pp. 215-230.

L.B. Rabiner & R.W. Sshafer, Digital Processing of Speech Signals 396-453 (1978).

Enhanced Variable Rate Codec, Speech Service Option 3 and 68 for Wideband Spread Spectrum Digital Systems, May 2006.

* cited by examiner

143

```
If (operating_anchor_point == 0)
 {
     If (speech mode is EQUAL to UNVOICED) {
             patterncount  = patterncount + c1 x p_fraction

             If (patterncount > c2) {
                change encoding mode for frame to full-rate CELP
                patterncount  = patterncount – c2
             }
     }
}

If (operating_anchor_point == 1) {
     If (speech mode is EQUAL to voiced AND SEM is EQUAL to PPP AND SER is EQUAL to quarter-rate) {
             patterncount  = patterncount + c1 x p_fraction

             If (patterncount > c2) {
                change encoding mode for frame to full-rate CELP
                patterncount  = patterncount – c2
             }
     }
}

If (operating_anchor_point == 2) {
     If (speech mode is EQUAL to voiced AND SEM is EQUAL to PPP AND SER is EQUAL to quarter-rate AND the last frame was Q-PPP) {
             patterncount  = patterncount + c1 x p_fraction

             If (patterncount > c2) {
                change encoding mode for frame to full-rate CELP
                patterncount  = patterncount – c2
             }
     }
}
```

FIG. 26

ARBITRARY AVERAGE DATA RATES FOR VARIABLE RATE CODERS

RELATED APPLICATIONS

This application claims benefit of U.S. Provisional Patent Application No. 60/760,799, filed Jan. 20, 2006, entitled "METHOD AND APPARATUS FOR SELECTING A CODING MODEL AND/OR RATE FOR A SPEECH COMPRESSION DEVICE." This application also claims benefit of U.S. Provisional Patent Application No. 60/762,010, filed Jan. 24, 2006, entitled "ARBITRARY AVERAGE DATA RATES FOR VARIABLE RATE CODERS."

BACKGROUND

I. Field

The present disclosure relates to signal processing, such as the coding of audio input in a speech compression device.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) may be required to achieve a speech quality of conventional analog telephone. However, through the use of speech analysis, followed by an appropriate coding, transmission, and resynthesis at the receiver, a significant reduction in the data rate can be achieved.

Devices for compressing speech find use in many fields of telecommunications. An exemplary field is wireless communications. The field of wireless communications has many applications including, e.g., cordless telephones, paging, wireless local loops, wireless telephony such as cellular and PCS telephone systems, mobile Internet Protocol (IP) telephony, and satellite communication systems. A particular application is wireless telephony for mobile subscribers.

Various over-the-air interfaces have been developed for wireless communication systems including, e.g., frequency division multiple access (FDMA), time division multiple access (TDMA), code division multiple access (CDMA), and time division-synchronous CDMA (TD-SCDMA). In connection therewith, various domestic and international standards have been established including, e.g., Advanced Mobile Phone Service (AMPS), Global System for Mobile Communications (GSM), and Interim Standard 95 (IS-95). An exemplary wireless telephony communication system is a code division multiple access (CDMA) system. The IS-95 standard and its derivatives, IS-95A, ANSI J-STD-008, and IS-95B (referred to collectively herein as IS-95), are promulgated by the Telecommunication Industry Association (TIA) and other well-known standards bodies to specify the use of a CDMA over-the-air interface for cellular or PCS telephony communication systems. Exemplary wireless communication systems configured substantially in accordance with the use of the IS-95 standard are described in U.S. Pat. Nos. 5,103,459 and 4,901,307.

The IS-95 standard subsequently evolved into "3G" systems, such as cdma2000 and WCDMA, which provide more capacity and high speed packet data services. Two variations of cdma2000 are presented by the documents IS-2000 (cdma2000 1xRTT) and IS-856 (cdma2000 1xEV-DO), which are issued by TIA. The cdma2000 1xRTT communication system offers a peak data rate of 153 kbps whereas the cdma2000 1xEV-DO communication system defines a set of data rates, ranging from 38.4 kbps to 2.4 Mbps. The WCDMA standard is embodied in 3rd Generation Partnership Project "3GPP", Document Nos. 3G TS 25.211, 3G TS 25.212, 3G TS 25.213, and 3G TS 25.214.

Devices that employ techniques to compress speech by extracting parameters that relate to a model of human speech generation are called speech coders. Speech coders typically comprise an encoder and a decoder. The encoder divides the incoming speech signal into blocks of time, or analysis frames. The duration of each segment in time (or "frame") is typically selected to be short enough that the spectral envelope of the signal may be expected to remain relatively stationary. For example, one typical frame length is twenty milliseconds, which corresponds to 160 samples at a typical sampling rate of eight kilohertz (kHz), although any frame length or sampling rate deemed suitable for the particular application may be used.

The encoder analyzes the incoming speech frame to extract certain relevant parameters, and then quantizes the parameters into binary representation, i.e., to a set of bits or a binary data packet. The data packets are transmitted over the communication channel (i.e., a wired and/or wireless network connection) to a receiver and a decoder. The decoder processes the data packets, unquantizes them to produce the parameters, and resynthesizes the speech frames using the unquantized parameters.

The function of the speech coder is to compress the digitized speech signal into a low-bit-rate signal by removing natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a number of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

Speech coders generally utilize a set of parameters (including vectors) to describe the speech signal. A good set of parameters ideally provides a low system bandwidth for the reconstruction of a perceptually accurate speech signal. Pitch, signal power, spectral envelope (or formants), amplitude and phase spectra are examples of the speech coding parameters.

Speech coders may be implemented as time-domain coders, which attempt to capture the time-domain speech waveform by employing high time-resolution processing to encode small segments of speech (typically 5 millisecond (ms) subframes) at a time. For each subframe, a high-precision representative from a codebook space is found by means of various search algorithms known in the art. Alternatively, speech coders may be implemented as frequency-domain coders, which attempt to capture the short-term speech spectrum of the input speech frame with a set of parameters (analysis) and employ a corresponding synthesis process to recreate the speech waveform from the spectral parameters. The parameter quantizer preserves the parameters by representing them with stored representations of code vectors in accordance with known quantization techniques.

A well-known time-domain speech coder is the Code Excited Linear Predictive (CELP) coder described in L. B. Rabiner & R. W. Schafer, *Digital Processing of Speech Signals* 396-453 (1978). In a CELP coder, the short-term correlations, or redundancies, in the speech signal are removed by a linear prediction (LP) analysis, which finds the coefficients of a short-term formant filter. Applying the short-term prediction filter to the incoming speech frame generates an LP residue signal, which is further modeled and quantized with long-term prediction filter parameters and a subsequent stochastic codebook. Thus, CELP coding divides the task of encoding the time-domain speech waveform into the separate tasks of encoding the LP short-term filter coefficients and encoding the LP residue. Time-domain coding can be performed at a fixed rate (i.e., using the same number of bits, $N_o$, for each frame) or at a variable rate (in which different bit rates are used for different types of frame contents). Variable-rate coders attempt to use only the amount of bits needed to encode the codec parameters to a level adequate to obtain a target quality. An exemplary variable rate CELP coder is described in U.S. Pat. No. 5,414,796.

Time-domain coders such as the CELP coder typically rely upon a high number of bits, $N_o$, per frame to preserve the accuracy of the time-domain speech waveform. Such coders typically deliver excellent voice quality provided that the number of bits, $N_o$, per frame is relatively large (e.g., 8 kbps or above). However, at low bit rates (e.g., 4 kbps and below), time-domain coders fail to retain high quality and robust performance due to the limited number of available bits. At low bit rates, the limited codebook space clips the waveform-matching capability of conventional time-domain coders, which are so successfully deployed in higher-rate commercial applications. Hence, despite improvements over time, many CELP coding systems operating at low bit rates suffer from perceptually significant distortion typically characterized as noise.

An alternative to CELP coders at low bit rates is the "Noise Excited Linear Predictive" (NELP) coder, which operates under similar principles as a CELP coder. However, NELP coders use a filtered pseudo-random noise signal to model speech, rather than a codebook. Since NELP uses a simpler model for coded speech, NELP achieves a lower bit rate than CELP. NELP is typically used for compressing or representing unvoiced speech or silence.

Coding systems that operate at rates on the order of 2.4 kbps are generally parametric in nature. That is, such coding systems operate by transmitting parameters describing the pitch-period and the spectral envelope (or formants) of the speech signal at regular intervals. Illustrative of these so-called parametric coders is the LP vocoder system.

LP vocoders model a voiced speech signal with a single pulse per pitch period. This basic technique may be augmented to include transmission information about the spectral envelope, among other things. Although LP vocoders provide reasonable performance generally, they may introduce perceptually significant distortion, typically characterized as buzz.

In recent years, coders have emerged that are hybrids of both waveform coders and parametric coders. Illustrative of these so-called hybrid coders is the prototype-waveform interpolation (PWI) speech coding system. The PWI coding system may also be known as a prototype pitch period (PPP) speech coder. A PWI coding system provides an efficient method for coding voiced speech. The basic concept of PWI is to extract a representative pitch cycle (the prototype waveform) at fixed intervals, to transmit its description, and to reconstruct the speech signal by interpolating between the prototype waveforms. The PWI method may operate either on the LP residual signal or the speech signal. An exemplary PWI, or PPP, speech coder is described in U.S. Pat. No. 6,456,964, entitled PERIODIC SPEECH CODING. Other PWI, or PPP, speech coders are described in U.S. Pat. No. 5,884,253 and W. Bastiaan Kleijn & Wolfgang Granzow, *Methods for Waveform Interpolation in Speech Coding*, in *Digital Signal Processing* 215-230 (1991).

There is presently a surge of research interest and strong commercial need to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall bit-budget of coder specifications and deliver a robust performance under channel error conditions.

One effective technique to encode speech efficiently at low bit rates is multimode coding. An exemplary multimode coding technique is described in U.S. Pat. No. 6,691,084, entitled VARIABLE RATE SPEECH CODING. Conventional multimode coders apply different modes, or encoding-decoding algorithms, to different types of input speech frames. Each mode, or encoding-decoding process, is customized to optimally represent a certain type of speech segment, such as, e.g., voiced speech, unvoiced speech, transition speech (e.g., between voiced and unvoiced), and background noise (non-speech) in the most efficient manner. An external, open-loop mode decision mechanism examines the input speech frame and makes a decision regarding which mode to apply to the frame. The open-loop mode decision is typically performed by extracting a number of parameters from the input frame, evaluating the parameters as to certain temporal and spectral characteristics, and basing a mode decision upon the evaluation. The mode decision is thus made without knowing in advance the exact condition of the output speech, i.e., how close the output speech will be to the input speech in terms of voice quality or other performance measures.

As an illustrative example of multimode coding, a variable rate coder may be configured to perform CELP, NELP, or PPP coding of audio input according to the type of speech activity detected in a frame. If transient speech is detected, then the frame may be encoded using CELP. If voiced speech is detected, then the frame may be encoded using PPP. If unvoiced speech is detected, then the frame may be encoded using NELP. However, the same coding technique can frequently be operated at different bit rates, with varying levels of performance. Different coding techniques, or the same coding technique operating at different bit rates, or combinations of the above may be implemented to improve the performance of the coder.

Skilled artisans will recognize that increasing the number of encoder/decoder modes will allow greater flexibility when choosing a mode, which can result in a lower average bit rate. The increase in the number of encoder/decoder modes will correspondingly increase the complexity within the overall system. The particular combination used in any given system will be dictated by the available system resources and the specific signal environment.

In spite of the flexibility offered by the new multimode coders, the current multimode coders are still reliant upon coding bit rates that are fixed. In other words, the speech coders are designed with certain pre-set coding bit rates, which result in average output rates that are at fixed amounts.

Figure 20:
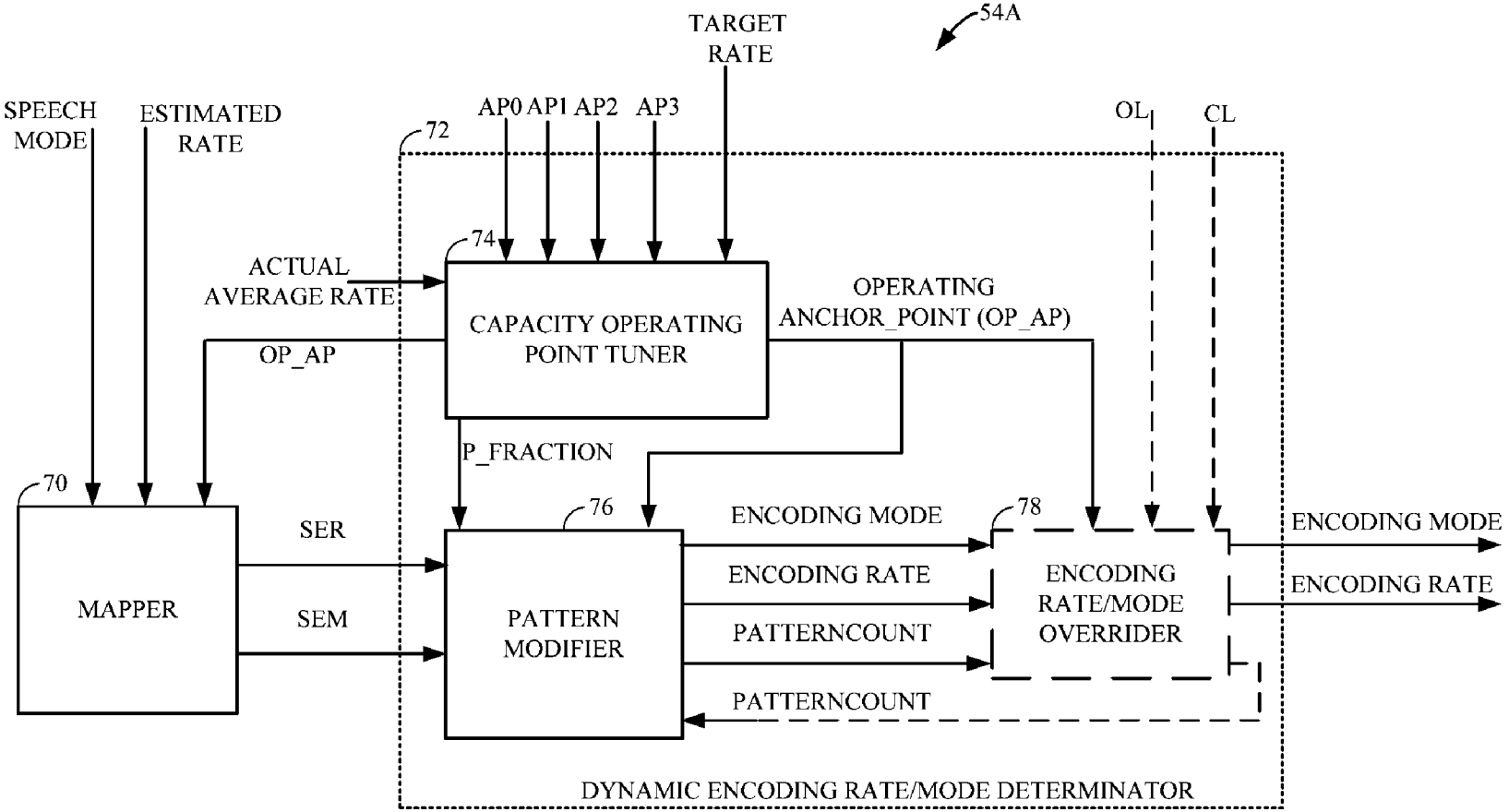

An exemplary encoding rate/mode determinator 54A is illustrated in FIG. 20.

Figure 21:
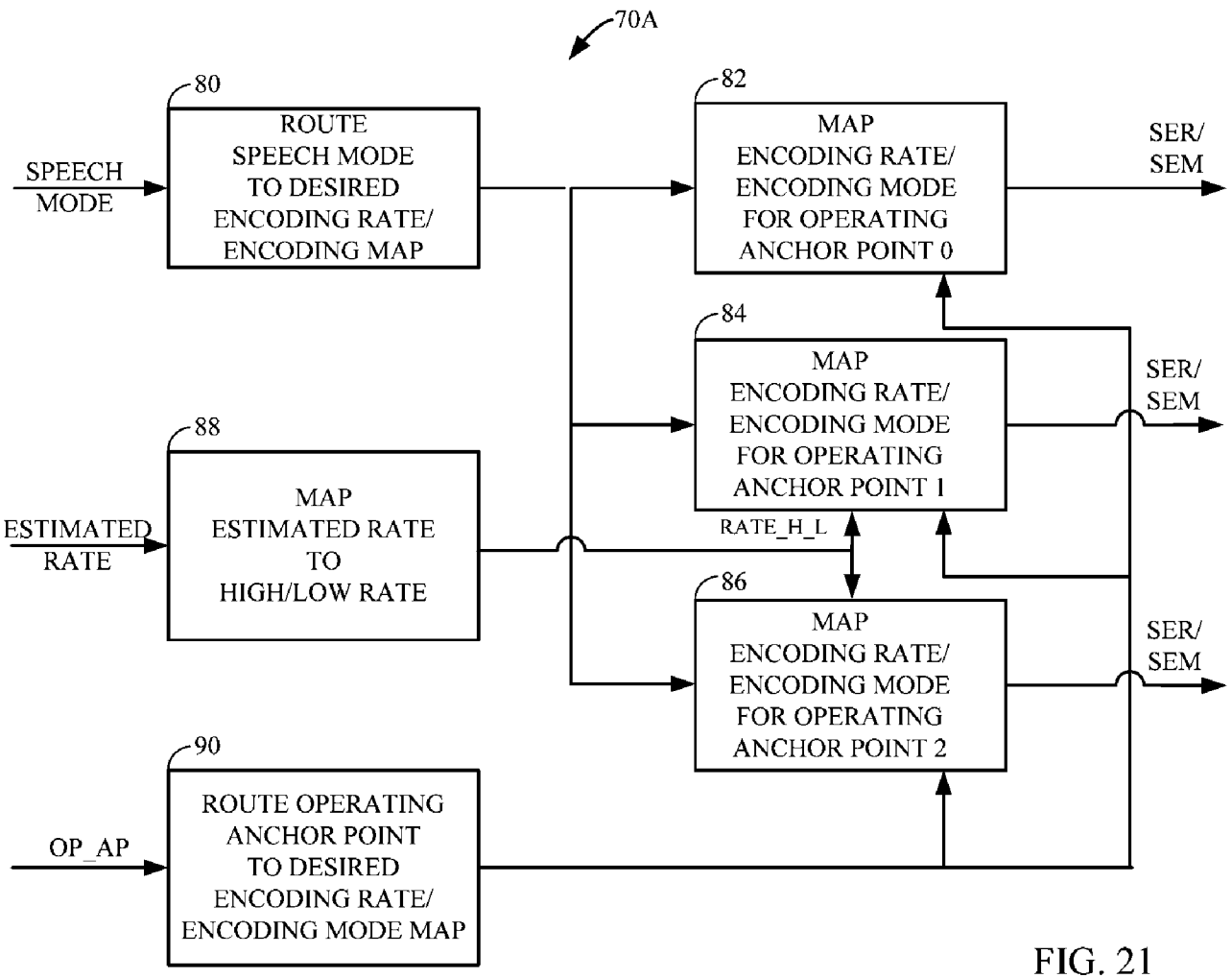

FIG. 21 is an illustration of a method to map speech mode and estimated rate to a suggested encoding mode (sem) and suggested encoding rate (ser).

Figure 22:
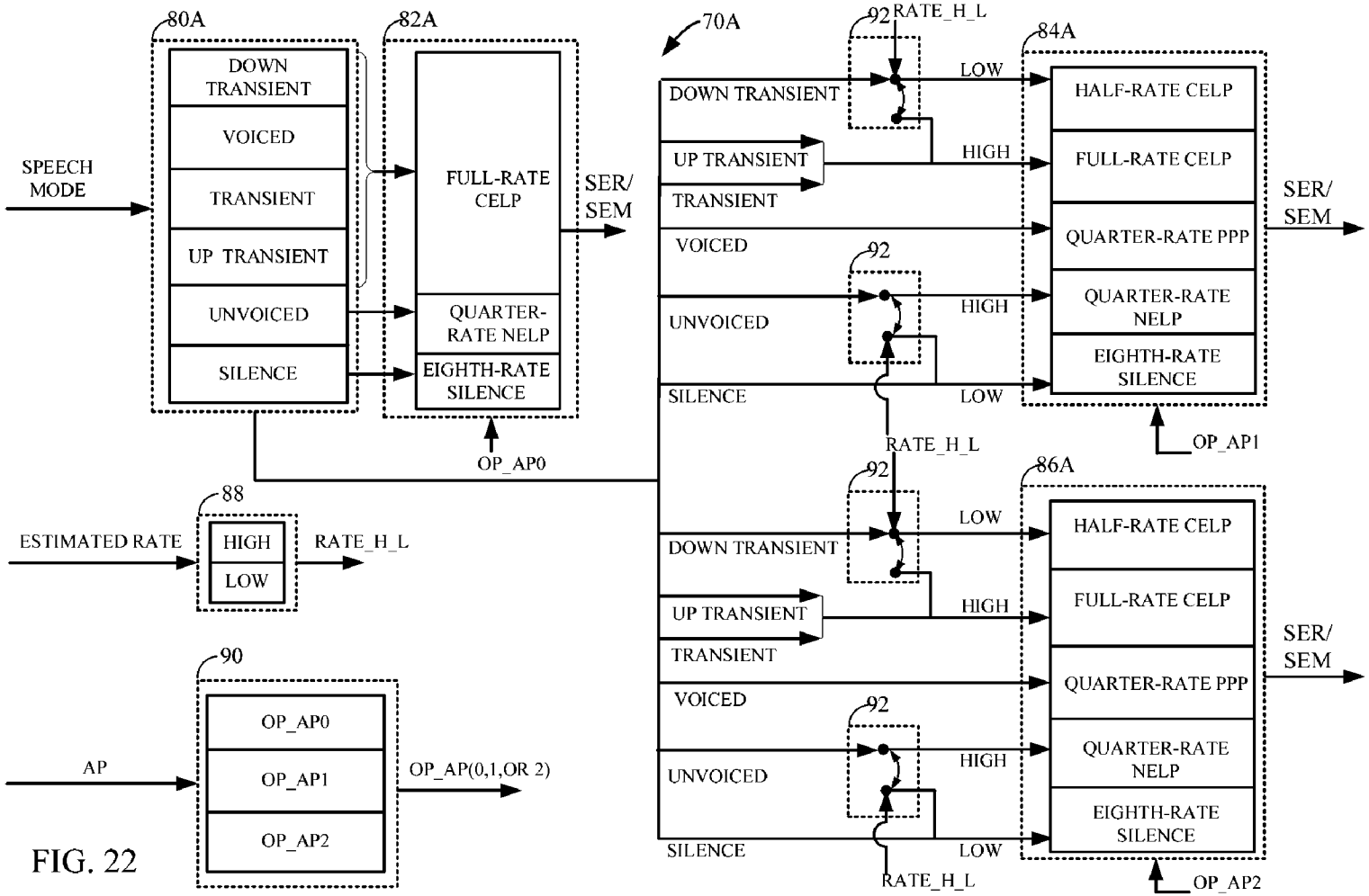

FIG. 22 is an exemplary illustration of a method to map speech mode and estimated rate to a suggested encoding mode (sem) and suggested encoding rate (ser).

Figure 23:
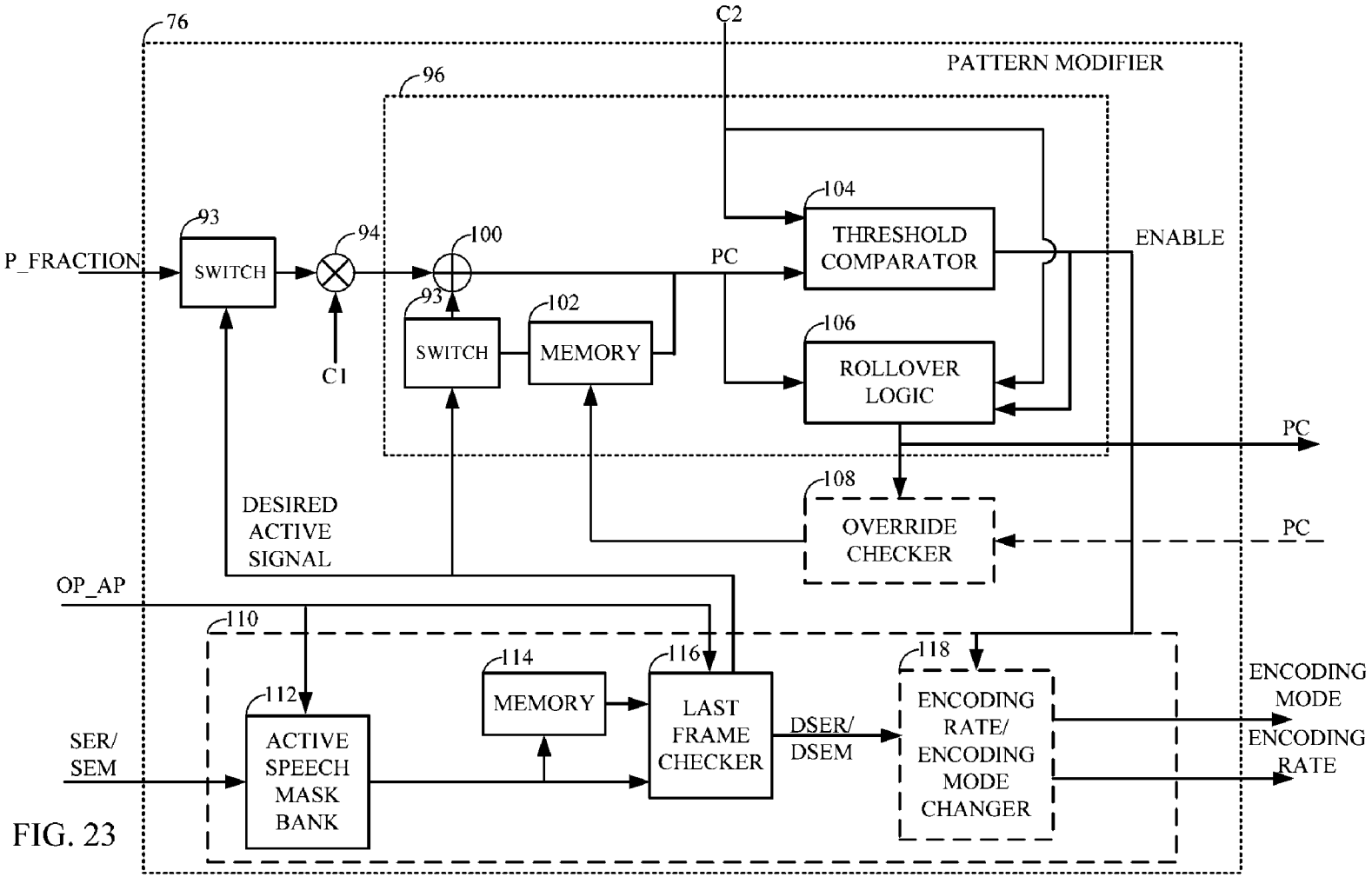

FIG. 23 illustrates a configuration for pattern modifier 76. Pattern modifier 76 outputs a potentially different encoding mode and encoding rate than the sem and ser.

Figure 24:
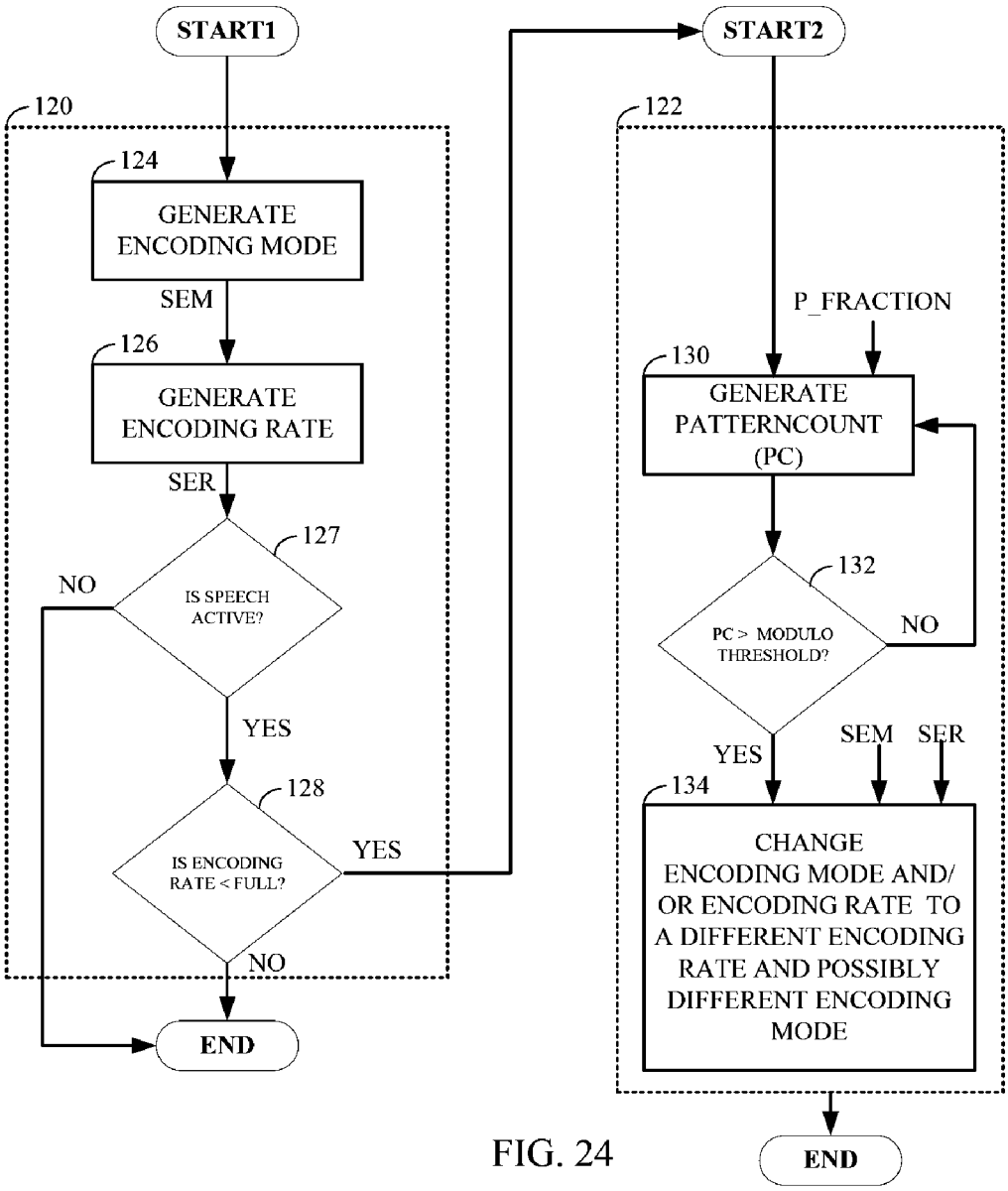

FIG. 24 illustrates a way to change encoding mode and/or encoding rate to a different encoding rate and possibly different encoding mode.

Figure 25:
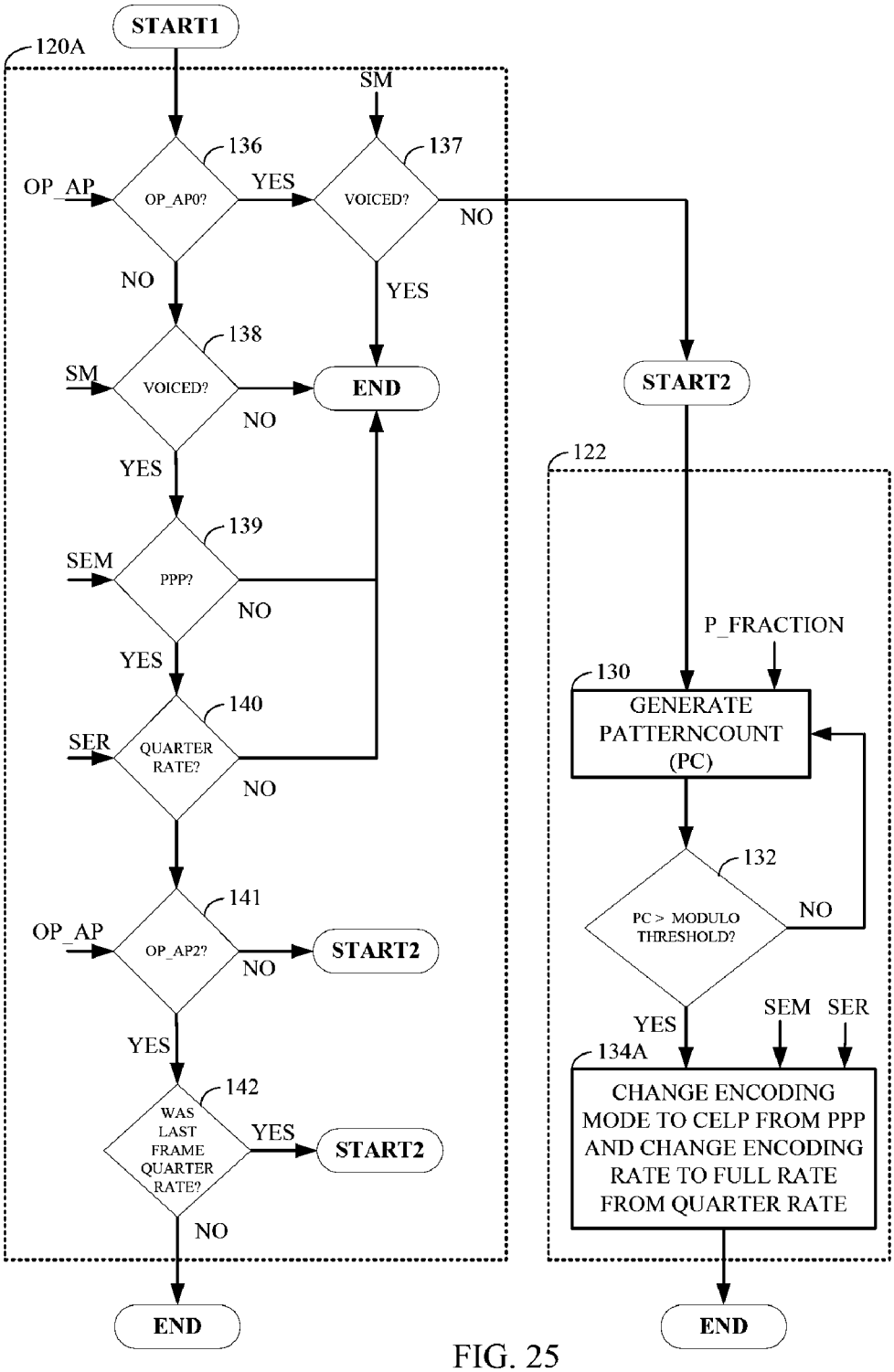

FIG. 25 is another exemplary illustration of a way to change encoding mode and/or encoding rate to a different encoding rate and possibly different encoding mode.

FIG. 26 is an exemplary illustration of pseudocode that may implement a way to change encoding mode and/or encoding rate depending on operating anchor point.

SUMMARY

Methods and apparatus are presented herein for new rate control mechanisms that may be implemented to allow a speech codec to output variable, continuous average output rates rather than fixed average output rates.

In one aspect, a finite set of initial rates and a target average rate are used to achieve an arbitrary rate in between two of the initial rates. The initial rates may be selected from a predetermined set of composite rates.

A method according to one configuration for achieving an arbitrary average data rate for a variable rate coder includes selecting a first composite rate less than the arbitrary average data rate; selecting a second composite rate greater than the arbitrary average data rate; and calculating a reallocation fraction based on the first and second composite rates. This method includes reassigning, based on the reallocation fraction, a plurality of frames assigned to a first component rate of the first composite rate to a second component rate of the first composite rate, wherein the second component rate is different than the first component rate. Related apparatus and computer program products are also disclosed.

A method according to another configuration for achieving an arbitrary capacity for a network includes determining a capacity operating point for the network; and setting an arbitrary average data rate for a set of devices accessing the network. The arbitrary average data rate is set in accordance with the capacity operating point. This method includes selecting first and second initial composite rates surrounding the arbitrary average data rate; and calculating, based on the selected initial composite rates, a reallocation fraction. This method includes instructing at least one of the set of devices to reassign, based on the reallocation fraction, a plurality of frames assigned to a first component rate of the first composite rate to a second component rate of the first composite rate, wherein the second component rate is different than the first component rate.

A method according to another configuration for encoding frames according to a target rate includes selecting a composite rate from among a set of composite rates, wherein each of the set of composite rates includes a first allocation of frames to a first component rate of the selected composite rate and a second allocation of frames to a second component rate of the selected composite rate. This method includes calculating, based on the target rate and the selected composite rate, a reallocation fraction. This method includes reallocating, based on the reallocation fraction and the first allocation of the selected composite rate, frames from the first component rate of the selected composite rate to the second component rate of the selected composite rate.

DETAILED DESCRIPTION

The configurations described below reside in a wireless telephony communication system configured to employ a CDMA over-the-air interface. Nevertheless, it would be understood by those skilled in the art that a method and apparatus having features as described herein may reside in any of the various communication systems employing a wide range of technologies known to those of skill in the art, such as systems employing Internet telephony and systems employing Voice over IP (VoIP) over wired and/or wireless (e.g., CDMA, TDMA, FDMA, and/or TD-SCDMA) transmission channels.

Unless expressly limited by its context, the term "calculating" is used herein to indicate any of its ordinary meanings, such as computing, evaluating, generating, and selecting from a list of values. Where the term "comprising" is used in the present description and claims, it does not exclude other elements or operations. The term "A is based on B" is used to indicate any of its ordinary meanings, including the case "A is based on at least B." Unless otherwise expressly indicated, the terms "reallocating" and "reassigning" are used interchangeably.

Figure 1:
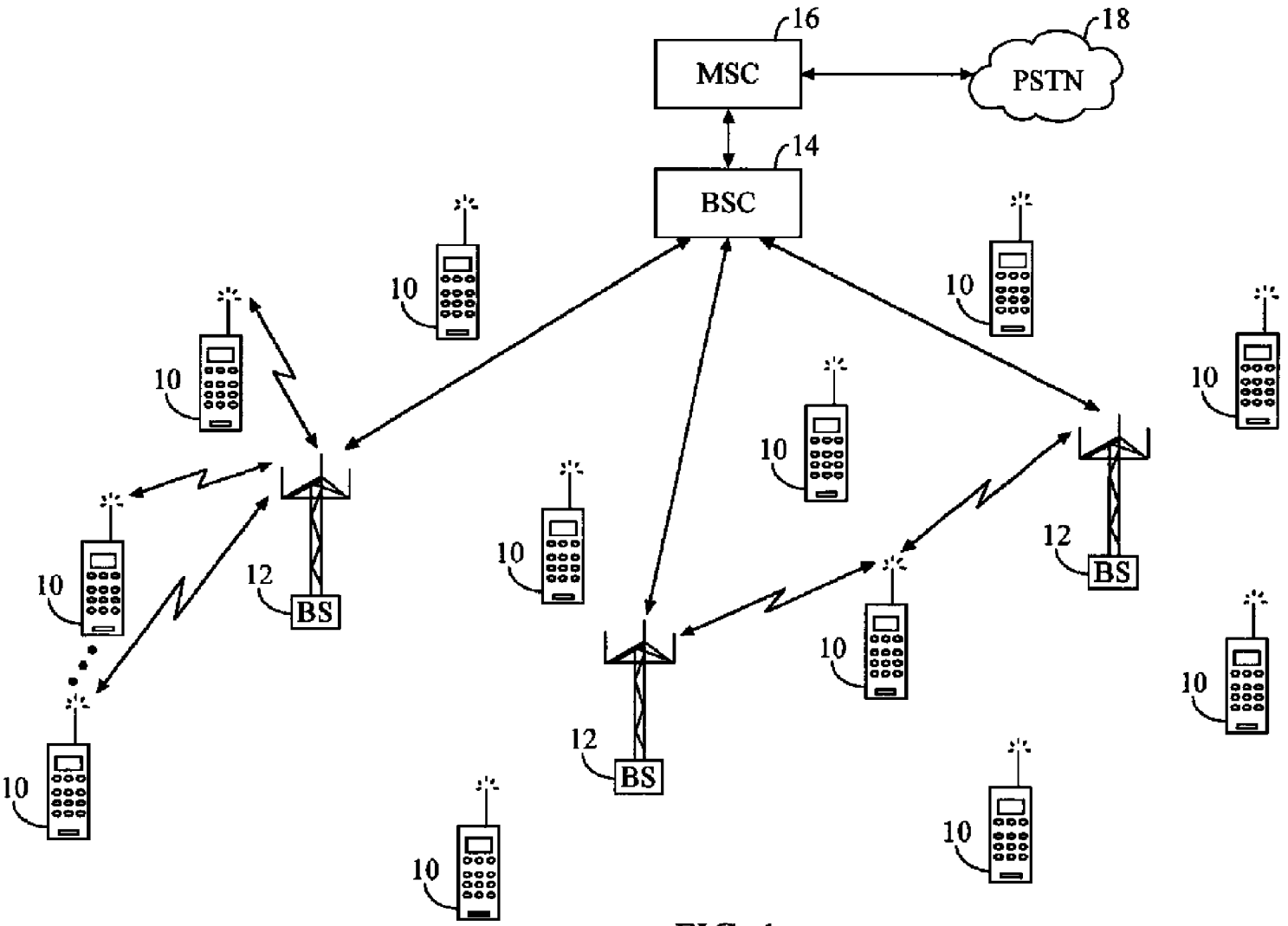
FIG. 1 PRIOR ART
FIG. 1 shows a diagram of a wireless telephone system

As illustrated in FIG. 1, a CDMA wireless telephone system generally includes a plurality of mobile subscriber units 10, a plurality of base stations 12, base station controllers (BSCs) 14, and a mobile switching center (MSC) 16. The MSC 16 is configured to interface with a conventional public switch telephone network (PSTN) 18. The MSC 16 is also configured to interface with the BSCs 14. The BSCs 14 are coupled to the base stations 12 via backhaul lines. The backhaul lines may be configured to support any of several known interfaces including, e.g., E1/T1, ATM, IP, PPP, Frame Relay, HDSL, ADSL, or xDSL. It is understood that there may be more than two BSCs 14 in the system. Each base station 12 advantageously includes at least one sector (not shown), each sector comprising an omnidirectional antenna or an antenna pointed in a particular direction radially away from the base station 12. Alternatively, each sector may comprise two antennas for diversity reception. Each base station 12 may advantageously be designed to support a plurality of frequency assignments. The intersection of a sector and a frequency assignment may be referred to as a CDMA channel. The base stations 12 may also be known as base station transceiver subsystems (BTSs) 12. Alternatively, "base station" may be used in the industry to refer collectively to a BSC 14 and one or more BTSs 12. The BTSs 12 may also be denoted "cell sites" 12. Alternatively, individual sectors of a given BTS 12 may be referred to as cell sites. The mobile subscriber units 10 are typically cellular or PCS telephones 10. The system is advantageously configured for use in accordance with the IS-95 standard.

During typical operation of the cellular telephone system, the base stations 12 receive sets of reverse link signals from sets of mobile units 10. The mobile units 10 are conducting telephone calls or other communications. Each reverse link signal received by a given base station 12 is processed within that base station 12. The resulting data is forwarded to the BSCs 14. The BSCs 14 provides call resource allocation and mobility management functionality including the orchestration of soft handoffs between base stations 12. The BSCs 14 also routes the received data to the MSC 16, which provides additional routing services for interface with the PSTN 18. Similarly, the PSTN 18 interfaces with the MSC 16, and the MSC 16 interfaces with the BSCs 14, which in turn control the base stations 12 to transmit sets of forward link signals to sets of mobile units 10.

Figure 2:
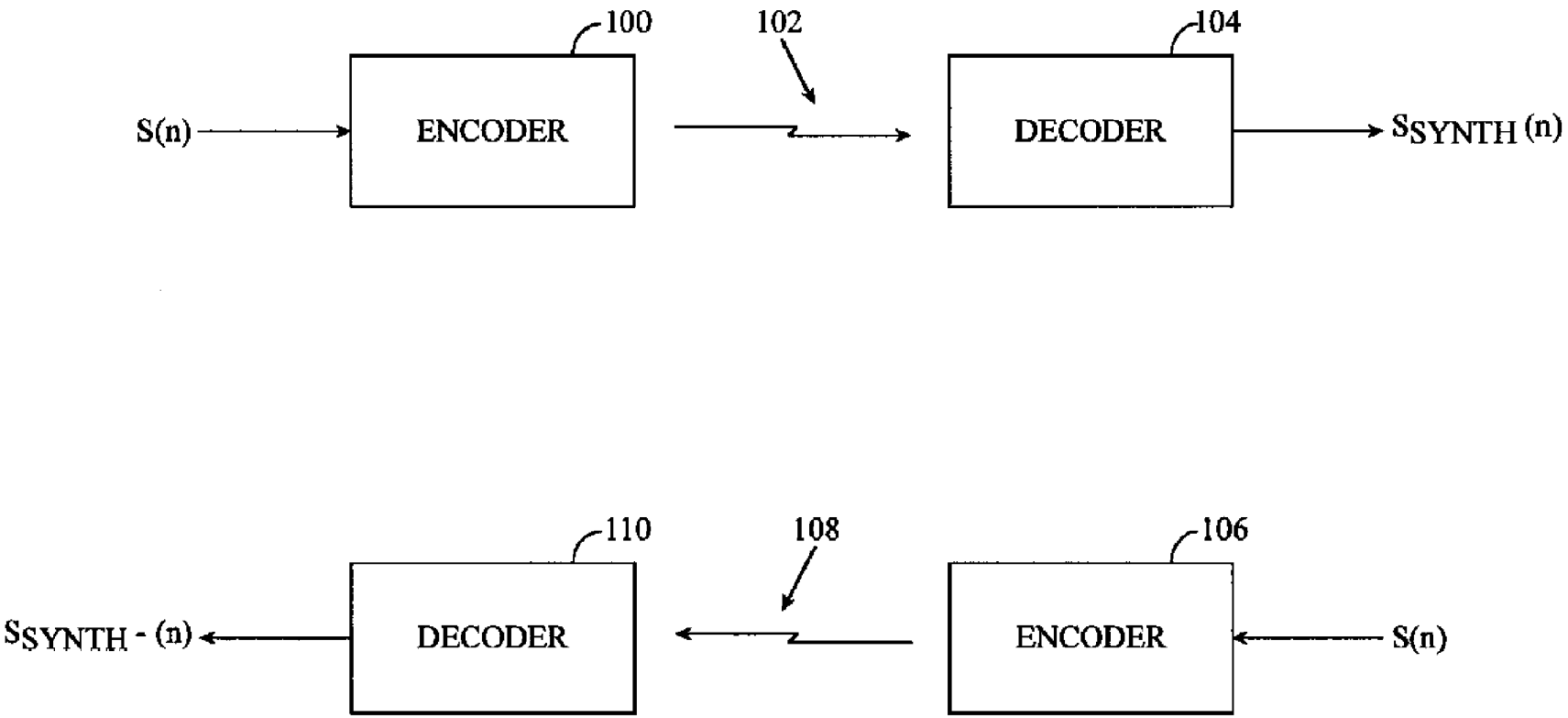
FIG. 2 PRIOR ART
FIG. 2 shows a block diagram of speech coders.

In FIG. 2 a first encoder 100 receives digitized speech samples s(n) and encodes the samples s(n) for transmission on a transmission medium 102, or communication channel 102, to a first decoder 104. The decoder 104 decodes the encoded speech samples and synthesizes an output speech signal $s_{SYNTH}(n)$. For transmission in the opposite direction, a second encoder 106 encodes digitized speech samples s(n), which are transmitted on a communication channel 108. A second decoder 110 receives and decodes the encoded speech samples, generating a synthesized output speech signal $s_{SYNTH}(n)$.

The speech samples s(n) represent speech signals that have been digitized and quantized in accordance with any of various methods known in the art including, e.g., pulse code modulation (PCM), companded μ-law, or A-law. As known in the art, the speech samples s(n) are organized into frames of input data wherein each frame comprises a predetermined number of digitized speech samples s(n). In one configuration, a sampling rate of 8 kHz is employed, with each 20 ms frame comprising 160 samples. In the configurations described below, the rate of data transmission may advantageously be varied on a frame-to-frame basis from 13.2 kbps (full rate) to 6.2 kbps (half rate) to 2.6 kbps (quarter rate) to 1 kbps (eighth rate). Varying the data transmission rate is advantageous because lower bit rates may be selectively employed for frames containing relatively less speech information. The terms "frame size" and "frame rate" are often used interchangeably to denote the transmission data rate since the terms are descriptive of the traffic packet types. As understood by those skilled in the art, other sampling rates, frame sizes, and data transmission rates may be used.

The first encoder 100 and the second decoder 110 together comprise a first speech coder. A speech coder is also referred to as a speech codec or a vocoder. The speech coder could be used in any communication device for transmitting speech signals, including, e.g., the subscriber units, BTSs, or BSCs described above with reference to FIG. 1. Similarly, the second encoder 106 and the first decoder 104 together comprise a second speech coder. It is understood by those of skill in the art that speech coders may be implemented using an array of logic elements such as a digital signal processor (DSP) or an application-specific integrated circuit (ASIC), discrete gate logic, firmware, and/or any conventional programmable software module and a microprocessor. The software module could reside in RAM memory, flash memory, registers, or any other form of writable non-transitory storage medium known in the art or to be developed. Alternatively, any conventional or future processor, controller, or state machine could be substituted for the microprocessor. Exemplary ASICs designed specifically for speech coding are described in U.S. Pat. No. 5,727,123 and U.S. Pat. No. 5,784,532.

The encoders and decoders may be implemented with any number of different modes to create a multimode encoding system. As discussed previously, an open-loop mode decision mechanism is usually implemented to make a decision regarding which coding mode to apply to a frame. The open-loop decision may be based on one or more features such as signal-to-noise ratio (SNR), zero crossing rate (ZCR), and high-band and low-band energies of the current frame and/or of one or more previous frames.

After open-loop classification of a speech frame, the speech frame is encoded using a rate $R_p$. Rate $R_p$ may be pre-selected in accordance with the coding mode that is selected by the open-loop mode decision mechanism. Alternatively, the open-loop decision may include selecting one of two or more coding rates for a particular coding mode. In one such example, the open-loop decision selects from among full-rate code-excited linear prediction (FCELP), half-rate CELP (HCELP), full-rate prototype pitch period (FPPP), quarter-rate PPP (QPPP), quarter-rate noise-excited linear prediction (QNELP), and an eighth-rate silence coding mode (e.g., NELP).

A closed-loop performance test may then be performed, wherein an encoder performance measure is obtained after full or partial encoding using the pre-selected rate $R_p$. Such a test may be performed before or after the encoded frame is quantized. Performance measures that may be considered in the closed-loop test include, e.g., signal-to-noise ratio (SNR), SNR prediction in encoding schemes such as the PPP speech coder, prediction error quantization SNR, phase quantization SNR, amplitude quantization SNR, perceptual SNR, and normalized cross-correlation between current and past frames as a measure of stationarity. If the performance measure, PNM, falls below a threshold value, PNM_TH, the encoding rate is changed to a value for which the encoding scheme is expected to give better quality. Examples of closed-loop classification schemes that may be used to maintain the quality of a variable-rate speech coder are described in U.S. application Ser. No. 09/191,643, entitled CLOSED-LOOP VARIABLE-RATE MULTIMODE PREDICTIVE SPEECH CODER, filed on Nov. 13, 1998, and in U.S. Pat. No. 6,330,532.

A frame encoded using PPP is commonly based on one or more previous prototypes or other references. In some cases, a memoryless mode of PPP may be used. For example, it may be desirable to use a memoryless mode of PPP for voiced frames that have a low degree of stationarity. Memoryless PPP may also be selected based on a desire to limit error propagation. A decision to use memoryless PPP may be made during an open-loop decision process or a closed-loop decision process.

Configurations described herein include systems, methods, and apparatus directed to improving control over the average data rate of speech coders, and in particular, variable rate coders. Current coders are still reliant upon target coding bit rates that are fixed. Because the target coding bit rates are fixed, the average data output rate is also fixed. For example, the cdma2000 speech codecs are variable rate coders that encode an input speech frame using one of four target rates, known as full rate, half rate, quarter rate, and eighth-rate. Although the average output of a variable rate vocoder may be varied by a combination of these four target rates, the average data output rate is limited to certain levels because the set of target rates is small and fixed.

Without loss of generality, let A, B, C, D be four different rates (e.g., in kilobits per second) used in a variable rate speech codec. The average rate of a codec computed over N frames is defined as follows:

$$r=(A*n_A+B*n_B+C*n_c+D*n_D)/N,$$

where r is the average rate, $n_A$ is the number of frames of rate A, $n_B$ is the number of frames of rate B, $n_C$ is the number of frames of rate C, and $n_D$ is the number of frames of rate D. Hence, the total number of frames N equals $n_A+n_B+n_C+n_D$. Such a rate is called a composite rate herein, as it is composed of frames encoded at different component rates.

In one example, the set of component rates (A,B,C,D) is (full-rate, half-rate, quarter-rate, eighth-rate). It may be desired in performing rate control to consider only active frames (frames containing speech information). For example, inactive frames (frames containing only background noise or silence) may be controlled by another mechanism such as a discontinuous transmission (DTX) or blanking scheme, in which fewer than all of the inactive frames are transmitted to the decoder. Thus it may be desired to express an average rate r with reference to the rates and corresponding numbers of frames for active frames only (e.g., full-, half-, and quarter-rate).

In the open-loop and closed-loop mechanisms described above, the mode, and consequently the rate, for a frame is selected based upon specific characteristics of the speech frame contents. Examples of some of these characteristics of speech include, but are not limited to, normalized autocorrelation functions (NACF), zero crossing rates, and signal band energies. Selected characteristics, and an associated set of thresholds for each of the selected characteristics, are used in a multidimensional decision process that is designed so that a coder achieves a pre-determined average rate over a large number of frames. In general, a large number of frames may be ten or more (e.g., one hundred, one thousand, ten thousand), corresponding to a period measured in tenths of seconds, seconds, or even minutes (e.g., a period long enough that a representative average statistic may be obtained). Moreover, some coders are configured to operate with a set of pre-determined average rates by using pre-determined sets of thresholds and an appropriately designed decision making mechanism. However, due to the complexity of the multi-dimensional decision making process, the current state of the art only allows for a speech codec to have a rather small number of average rates that can be achieved by a speech codec. For example, the number of average rates available may be less than nine.

At least some of the methods and apparatus presented herein may be used to enable a speech codec to achieve a significantly high number of average rates without the added complexity of a multi-dimensional decision making process. The configurations may be implemented using the components of already existing speech coders. In particular, at least one memory element (e.g., an array of storage elements such as a semiconductor memory device) and at least one array of logic elements (e.g., a processing element) may be configured to execute instructions for performing the various configurations described below.

Let $r_1$, $r_2$, $r_3$, $r_4$, $r_5$, $r_6$ be a set of six pre-determined composite rates that can be achieved by a variable speech coder over N frames using a set of four component frame rates A, B, C, and D, using methods known in the art (or equivalents). Without loss of generality, let $r_1<r_2<r_3<r_4<r_5<r_6$. Furthermore, let $r_1$ be achieved using $n_{A1}$, $n_{B1}$, $n_{C1}$, and $n_{D1}$, number of frames; let $r_2$ be achieved using $n_{A2}$, $n_{B2}$, $n_{C2}$, and $n_{D2}$ number of frames; let $r_3$ be achieved using $n_{A3}$, $n_{B3}$, $n_{C3}$, and $n_{D3}$ number of frames; let $r_4$ be achieved using $n_{A4}$, $n_{B4}$, $n_{C4}$, and $n_{D4}$ number of frames; let $r_5$ be achieved using $n_{A5}$, $n_{B5}$, $n_{C5}$, and $n_{D5}$ number of frames; and let $r_6$ be achieved using $n_{A6}$, $n_{B6}$, $n_{C6}$, and $n_{D6}$ number of frames. Each value $n_{Ax}$, $n_{Bx}$, $n_{Cx}$, or $n_{Cx}$ is the number of frames of rates A, B, C, of D, respectively, associated with composite rate $r_x$. Without loss of generality, let A<B<C<D. Then, $$r_1=(A*n_{A1}+B*n_{B1}+C*n_{C1}+D*n_{D1})/N,$$

$$r_2=(A*n_{A2}+B*n_{B2}+C*n_{C2}+D*n_{D2})/N,$$

$$r_3=(A*n_{A3}+B*n_{B3}+C*n_{C3}+D*n_{D3})/N,$$

$$r_4=(A*n_{A4}+B*n_{B4}+C*n_{C4}+D*n_{D4})/N,$$

$$r_5=(A*n_{A5}+B*n_{B5}+C*n_{C5}+D*n_{D5})/N,$$

$$r_6=(A*n_{A6}+B*n_{B6}+C*n_{C6}+D*n_{D6})/N,$$

where $N=n_{A1}+n_{B1}+n_{C1}+n_{D1}=n_{A2}+n_{B2}+n_{C2}+n_{D2}= \ldots =n_{A6}+n_{B6}+n_{C6}+n_{D6}$. As noted above, it may be desired to consider the composite rates based on active frames only.

Suppose that an arbitrary, target average data rate $r_T$ is selected. In one configuration, two of the composite rates are used to achieve the arbitrary average date rate $r_T$. These two initial rates $r_L$ and $r_H$ may be any from the set of pre-determined composite rates, as long as they lie on opposite sides of $r_T$. For illustrative purposes, suppose that one of the composite rates $r_3$ is lower than $r_T$ and another of the composite rates $r_4$ is greater than $r_T$. Then we may select $r_3$ and $r_4$ from the set ($r_1$, $r_2$, $r_3$, $r_4$, $r_5$, $r_6$) as the initial rates $r_L$ and $r_H$, since $r_3<r_T<r_4$. Note that $r_2$ and $r_5$ also may have been selected as the initial rates, or any other pair of composite rates, as long as one of the initial rates is less than $r_T$ and the other is greater than $r_T$. The configuration includes using these initial rates to reallocate some or all of the frames associated with one component rate to another component rate.

In the above example, the arbitrary average rate of $r_T$ is achieved by reallocating a suitable fraction of a set of frames from one component rate of composite rate $r_L$ to a higher component rate. For example, the number of frames encoded at a (comparatively) low component rate B to achieve the composite rate $r_L$ is $n_{BL}$, and the number of frames encoded at a higher component rate D to achieve the composite rate $r_L$ is $n_{DL}$. In this example, in order to reach $r_T$, we decrease the number of frames to be encoded at component rate B to less than $n_{BL}$ and correspondingly, increase the number of frames to be encoded at component rate D to more than $n_{DL}$. The number of B frames to reallocate to the higher component rate D may be determined using the following fraction:

$$f_{BtoD}=(r_T-r_L)/(r_H-r_L).$$

Figure 4:
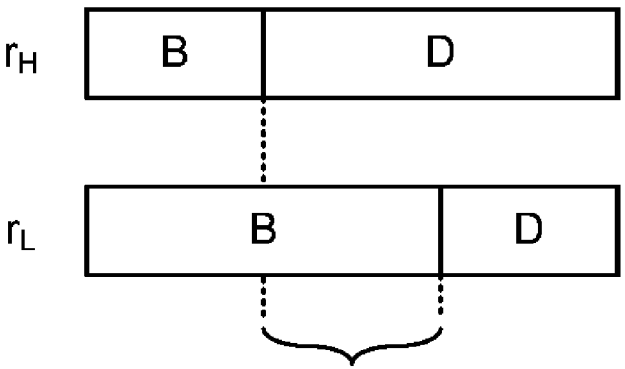
FIG. 4 shows a portion of frames for potential reallocation.

To determine the number of B frames that will be reallocated to component rate D, the fraction $f_{BtoD}$ is applied to the difference ($n_{BL}-n_{BH}$) (which difference is indicated by the brace in FIG. 4). For example, using the constraints for composite rates ($r_1$, $r_2$, $r_3$, $r_4$, $r_5$, $r_6$) and component rates (A, B, C, D) as described above, suppose 20 frames are used to achieve composite rate $r_3$, of which ten (10) frames are B frames and ten (10) are D frames, and that 20 frames are used to achieve composite rate $r_4$, of which four frames are B frames and sixteen frames are D frames. Suppose a rate $r_T<r_4$ is arbitrarily selected so that the resulting reallocation fraction $f_{BtoD}$ equals ½. Then three B frames (one-half of (10-4)) would be reallocated for coding as D frames and the end result would be seven (7) B frames and thirteen (13) D frames. In this manner, the average rate of the coder would be increased from rate $r_3$ to rate $r_T$.

In general, the average rate $r_T$ resulting from such a reallocation from component rate B to component rate D may be expressed as $$r_T=(1/N)(A*n_{AL}+C*n_{CL}+B*n_{BH}+D*n_{DL}+[fD+(1-f)B][n_{DH}-n_{DL}]).$$

In a case where applying the reallocation fraction results in a fractional number of frames, the result may be rounded to a whole number of frames, as each frame is typically encoded using only one rate, although applying more than one rate to a frame is also contemplated.

Figure 3:
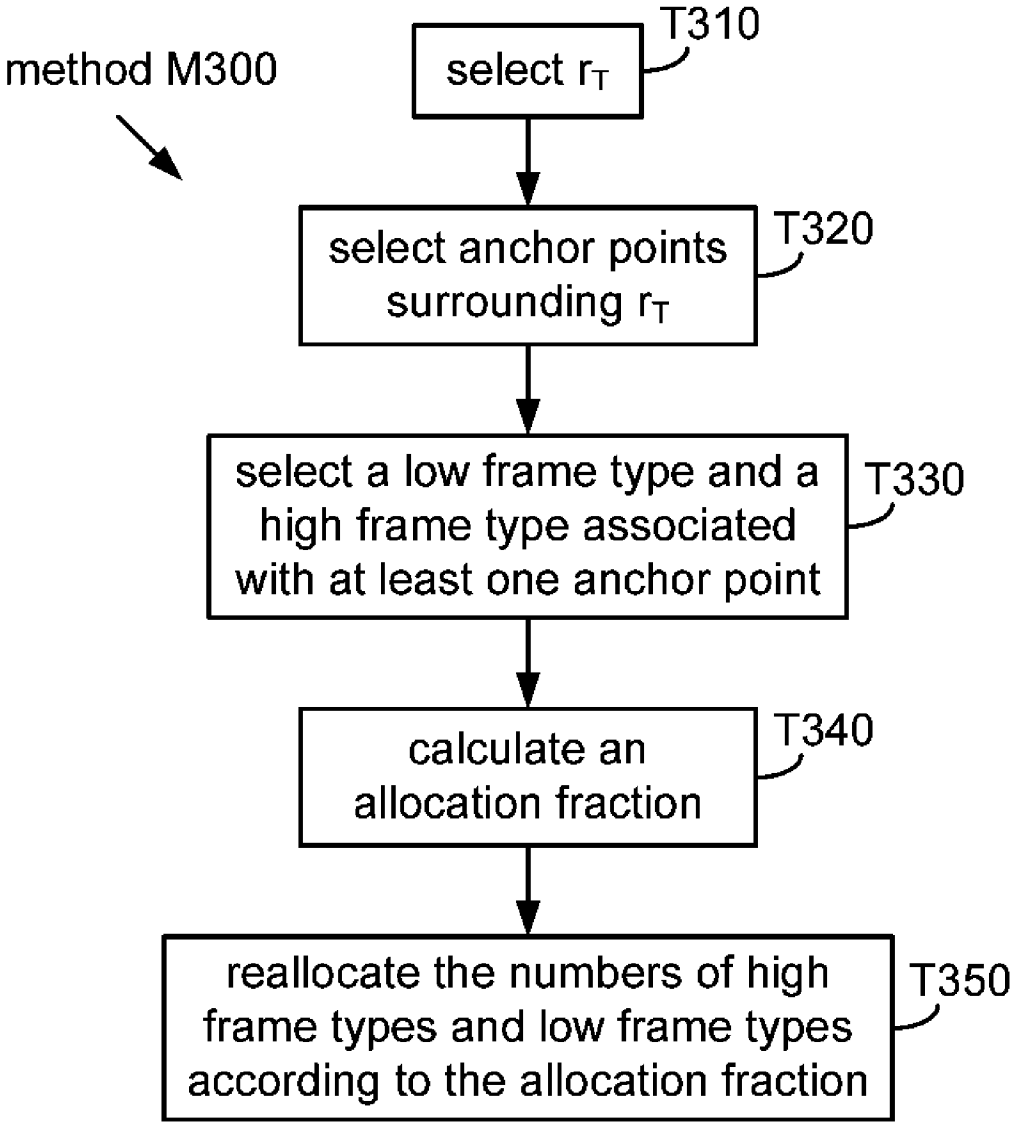
FIG. 3 shows a flowchart of a method M300 according to a configuration.

FIG. 3 is a flowchart of a general description of a method M300 according to one such configuration. Task T310 selects an arbitrary target average rate $r_T$ (e.g., according to a command and/or calculation). Task T320 selects two initial composite rates ("anchor points") $r_i$ and $r_j$, where $r_i<r_T<r_j$. Task T330 selects a low rate frame type used to achieve anchor point $r_i$ and a high rate frame type used to achieve anchor point $r_i$. Task T340 calculates a reallocation fraction that will be used to decrease the number of low rate frames and increase the number of high rate frames as compared to the numbers of such frames that are associated with anchor point $r_i$. The general form for the reallocation fraction is given by:

$$f=(r_T-r_i)/(r_j-r_i), \text{ wherein } r_i<r_j.$$

Task T350 reallocates the number of low rate frames and the number of high rate frames according to the reallocation fraction.

In another implementation of this configuration, the average rate $r_T$ may be achieved by starting from the higher initial composite rate $r_4$, and sending a suitable fraction of the number of frames from a higher component rate, for example D, to a lower component rate, such as B. The number of frames to reallocate to the lower component rate B may be determined using the following fraction:

$$f_{DtoB}=(r_H-r_T)/(r_H-r_L).$$

Figure 5:
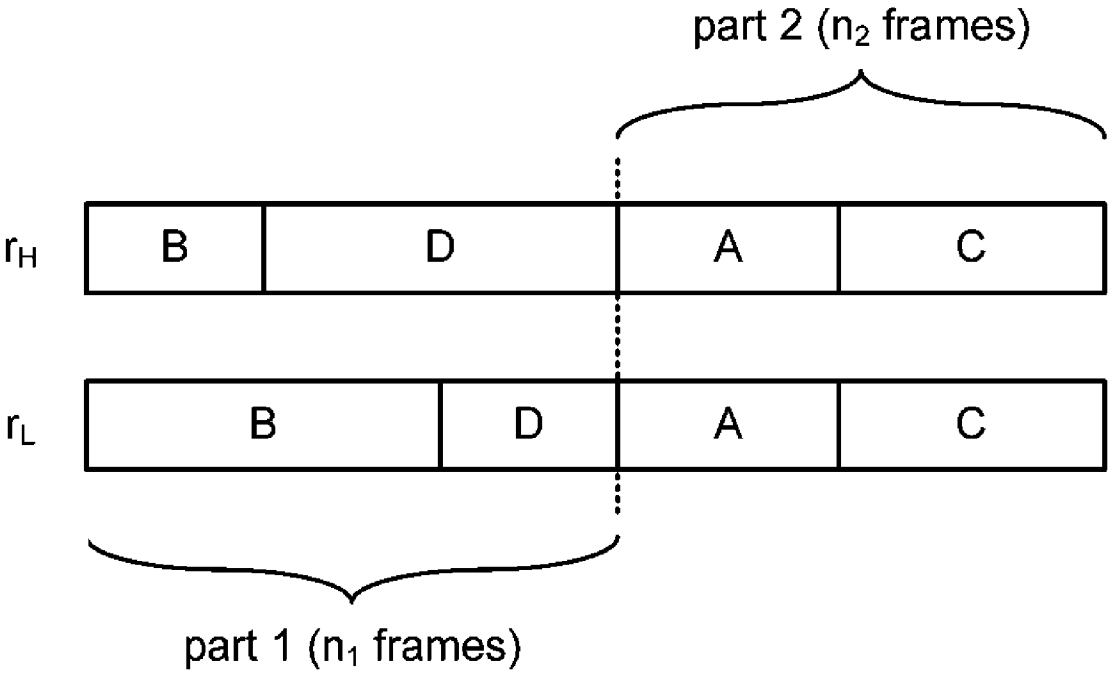
FIGS. 5, 6, and 7 show examples of pairs of initial composite rates.
Figure 6:
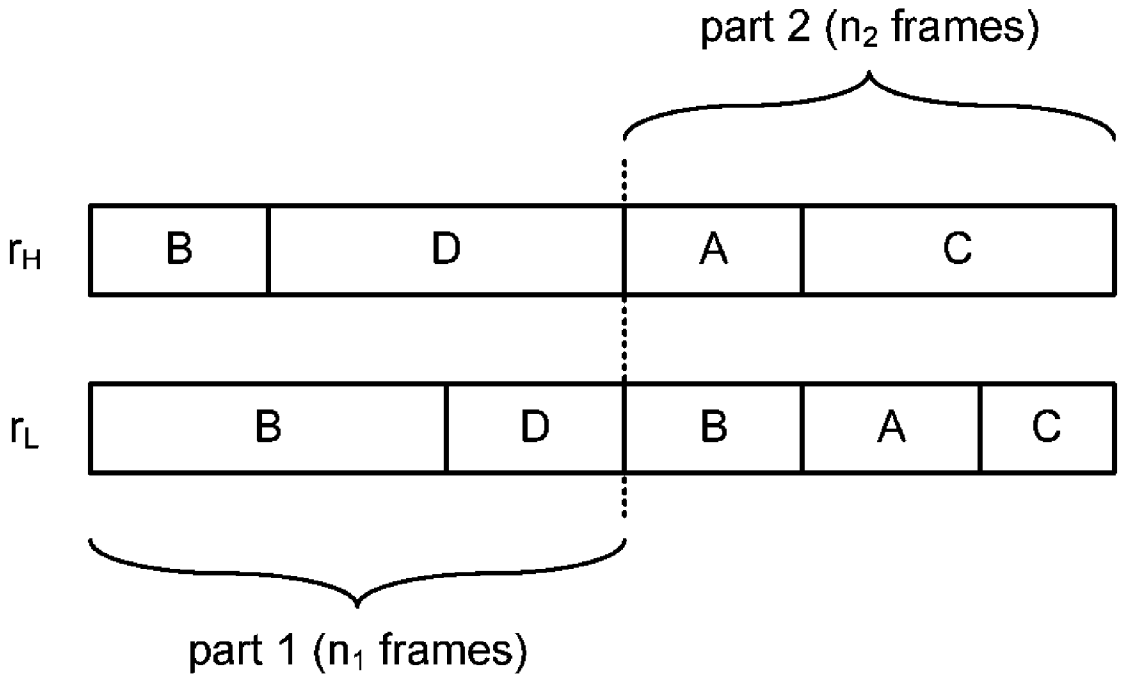
Figure 7:
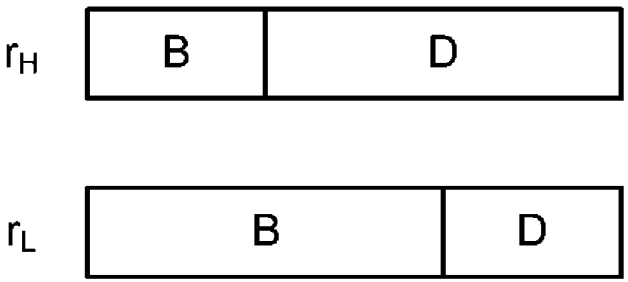

In general, a reallocation as described above may be applied to any case in which the two initial composite rates $r_L$ and $r_H$ are based on the same number of frames and in which, for both rates $r_L$ and $r_H$, that number of frames may be divided into two parts: 1) a part (part 1) including only frames allocated to a source component rate $R_s$ or to a destination component rate $R_d$ and having the same number of frames $n_1$ for both of the initial rates $r_L$ and $r_H$, and 2) a remainder (part 2) which has the same number of frames $n_2$, and the same overall rate K, for both of the initial rates $r_L$ and $r_H$. FIGS. 5 and 6 shows two such examples. FIG. 7 shows a further example in which the remainder (part 2) is empty. The average rate $r_T$ in such a case where the rate $r_T$ is calculated as an increase from rate $r_L$ may be expressed as $$r_T=(1/N)(K+R_s*n_{RsH}+R_d*n_{RdL}+[fR_d+(1-f)R_s][n_{RdH}-n_{RdL}]).$$

A case in which the rate $r_T$ is calculated as a decrease from rate $r_H$ may be expressed analogously.

Such a configuration may also be used for a case in which the overall rate in the remainder differs between the two initial composite rates. In this case, however, the range of rates that may be achieved via a reallocation as described above may not correspond to the range ($r_L$ to $r_H$). For example, if the overall rate for the remainder in initial composite rate $r_H$ is greater than the overall rate for the remainder in composite rate $r_L$, then reallocation of frames among the component rates in part 1 will not be enough to reach composite rate $r_H$ from composite rate $r_L$. One option may be to perform such reallocation anyway, if the desired average rate $r_T$ is within the available range. Another option would be to perform the reallocation from composite rate $r_H$ downward, as in this case such reallocation yields a different result than from composite rate $r_L$ upward and may provide a range that includes the desired target $r_T$. Another option is to perform an iterative process in which a reallocation is followed by a repartition of the initial composite rates into different parts 1 and 2. In this case, the rate resulting from the reallocation may be used in the repartition, taking the place of one of the initial composite rates.

A method according to one configuration includes selecting a target rate $r_T$; selecting an initial composite rate (anchor point) $r_L$; selecting a candidate initial composite rate $r_H$; and choosing the source and destination component rates. A good source component rate may be one that is allocated significantly more frames in composite rate $r_L$ than in composite rate $r_H$, and a good destination component rate may be one that is allocated significantly more frames in composite rate $r_H$ than in composite rate $r_L$. In a typical implementation, anchor point $r_L$ is selected from a set of composite rates, and the lowest composite rate of the set that is greater than $r_L$ is selected to be composite rate $r_H$. The method may also include (e.g., after the source and destination component rates have been selected) determining whether the maximum available rate is sufficiently above (alternatively, below) the target rate $r_T$, or determining in which direction to perform the reallocation (i.e., upward from $r_L$ or downward from $r_H$). For example, it may be desired to leave some margin between the desired target rate and the source and destination composite rates. The method may also include selecting a new candidate for composite rate $r_H$ and/or composite rate $r_L$ for re-evaluation as needed.

Figure 8:
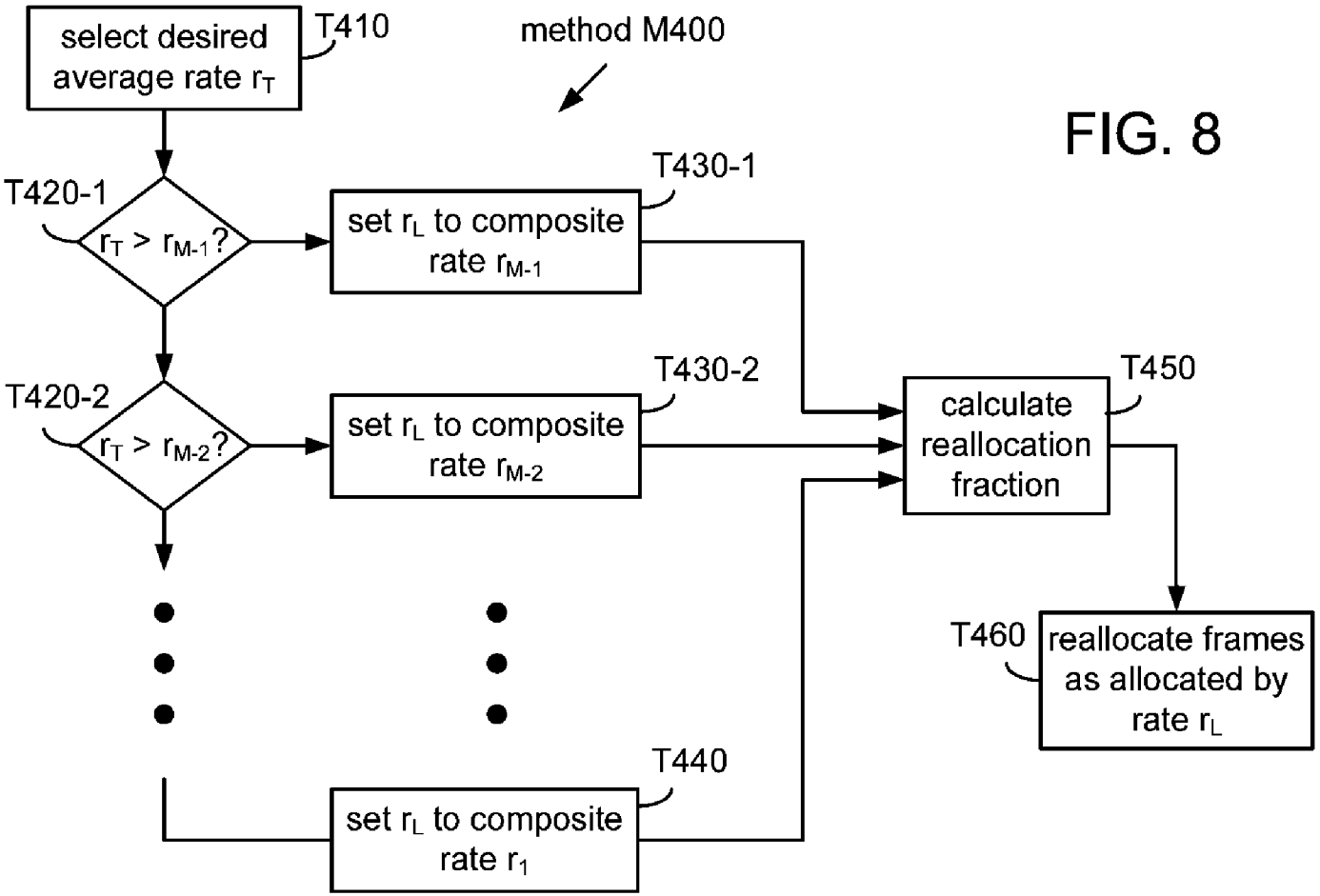
FIG. 8 shows a flowchart of a method M400 according to a configuration.

FIG. 8 shows a flowchart of a method M400 according to another configuration. Based on a desired average rate $r_T$, method M400 selects anchor point $r_L$ as the highest of a set of M composite rates $r_1<r_2< \ldots <r_M$ that is less than $r_T$. It is assumed that the desired average rate $r_T$ is in the range of $r_1$ to $r_M$. In this example, method M400 is configured to select anchor point $r_L$ from among the lowest M−1 of the set of M composite rates.

Task T410 selects a desired arbitrary average rate $r_T$ (e.g., according to a command and/or channel quality information received from a network). Task T420-1 compares the desired rate $r_T$ to composite rate $r_{M-1}$. If the desired rate $r_T$ is greater than composite rate $r_{M-1}$, then task T430-1 sets anchor point $r_L$ to composite rate $r_{M-1}$. Otherwise, one or more other iterations of task 420 compares rate $r_T$ to progressively smaller values of the set of M composite rates until the highest composite rate that is less than the desired average rate $r_T$ is found, and a corresponding instance of task T430 sets anchor point $r_L$ to that composite rate. If the desired rate $r_T$ is not greater than composite rate $r_2$, then task T440 sets anchor point $r_L$ to composite rate $r_1$ by default.

Task T450 calculates a reallocation fraction f as described herein. For example, task T450 may be configured to calculate the reallocation fraction f according to an expression such as:

$$f=(r_T-r_L)/(r_H-r_L),$$

where $r_H$ is the lowest of the M composite rates that is greater than $r_L$ (i.e., the lowest composite rate that is greater than $r_T$). Based on the reallocation fraction, task T460 reallocates one or more frames by changing the rate and/or mode assignments indicated for those frames by the selected anchor point $r_L$. In one particular implementation of method M400, the number M of composite rates is four, and the corresponding set of composite rates ($r_1$, $r_2$, $r_3$, $r_4$) is (5750, 6600, 7500, 9000) kilobits per second (kbps).

It will be readily understood that in another implementation, method M400 may be configured instead to select anchor point $r_H$ as the lowest of the M composite rates that is greater than $r_T$ (e.g., from among the highest M−1 of the set of M composite rates). In this case, task T420-1 may be configured to determine whether desired rate $r_T$ is less than composite rate $r_2$ (with further iterations of task 420 comparing rate $r_T$ to progressively larger values of the set of M composite rates), task T440 may be configured to set anchor point $r_H$ to composite rate $r_M$ by default, task T450 may be configured to calculate the reallocation fraction f according to an expression such as:

$$f=(r_H-r_T)/(r_H-r_L),$$

and task T460 may be configured to reallocate one or more frames by changing the rate and/or mode assignments indicated for those frames by the selected anchor point $r_H$.

Figure 9:
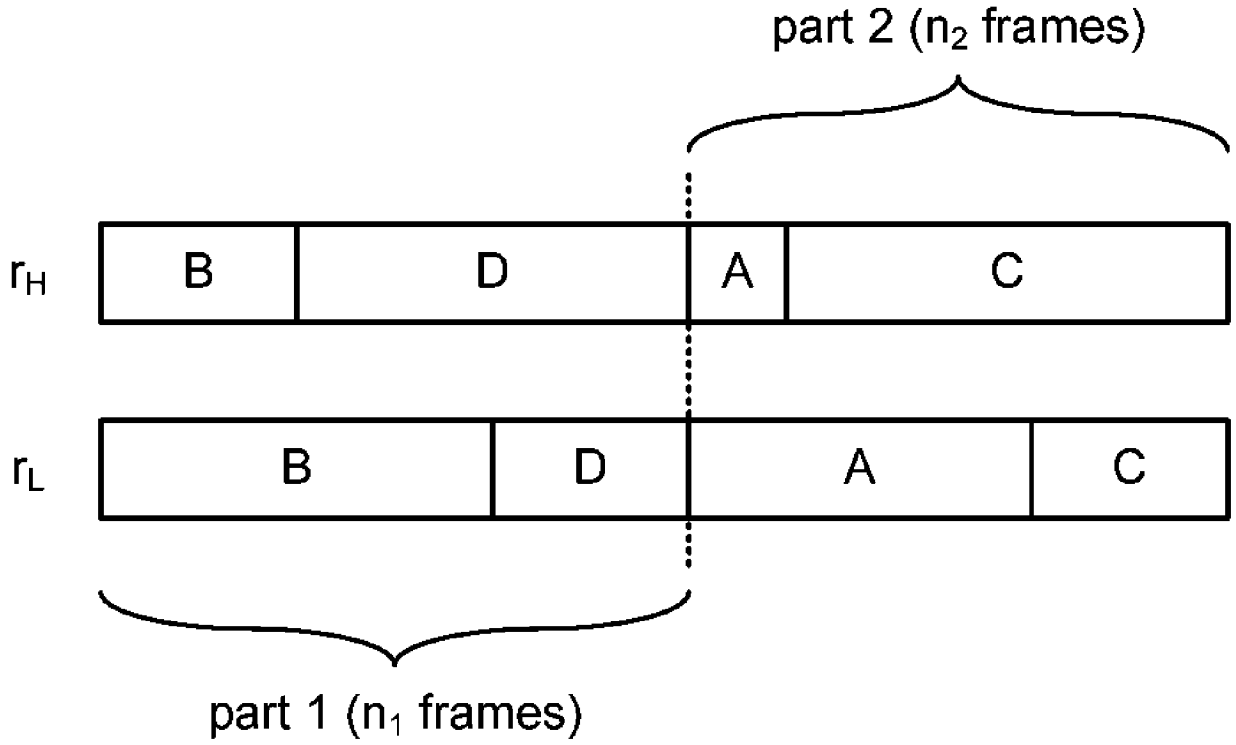
FIG. 9 shows an example in which two reallocations may be performed.

Other configurations of methods M300 or M400 may use more than two frame rates to achieve the arbitrary target average rate of $r_T$. FIG. 9 shows one such example, in which frames are reallocated between component rates B and D in part 1, and between component rates A and C in part 2. For the case in which both initial composite rates $r_L$ and $r_H$ include a remainder (possibly empty) having the same overall rate K and number of frames, the target rate $r_T$ may be expressed as follows:

$$r_T = (1/N)(K + A*n_{AH} + C*n_{CL} + [fC + (1-f)A][n_{CH} - n_{CL}] + B*n_{BH} + D*n_{DL} + [fD + (1-f)B][n_{DH} - n_{DL}]).$$

This case may be extended as above to situations in which the reallocation is downward and/or the overall rate in the remainder is different between the two initial composite rates.

In another example, a different reallocation fraction is used in parts 1 and 2:

$$r_T = (1/N)(K + A*n_{AH} + C*n_{CL} + [aC + (1-a)A][n_{CH} - n_{CL}] + B*n_{BH} + D*n_{DL} + [bD + (1-b)B][n_{DH} - n_{DL}]).$$

In this example, the reallocation factors a and b are selected according to the following constraints:

$$ap+b(1-p)=f; \quad 1)$$

$$0 \leqq a, b \leqq 1; \quad 2)$$

$$ap, b(1-p) \leqq f, \quad 2)$$

where p represents the portion of the overall distance between composite rates $r_L$ and $r_H$ that may be covered by reallocating all frames in ($n_{AL}-n_{AH}$) to component rate C:

$$p=[(A*n_{AH}+C*n_{CH})-(A*n_{AL}+C*n_{CL})]/(r_H-r_L).$$

This example may be extended as above to situations in which the reallocation is downward and/or the overall rate in the remainder is different between the two initial composite rates.

In another example, the fraction of the number of frames to be reallocated is given by:

$$f_{AtoC}=\alpha*(r_T-r_L)/(r_H-r_L), \text{ and}$$

$$f_{BtoD}=\beta*(r_T-r_L)/(r_H-r_L),$$

where α and β are weighting constants that may be selected by using constraints appropriate to the selected anchor points. For example, one constraint is that α and β relate to the total number of A and B frames and that α and β are inversely proportional to each other.

Once the reallocation fraction is determined, a decision may be made as to which frames to reallocate. In one example, as noted above, the fraction f indicates the proportion of the number of frames in the difference ($n_{BL}-n_{BH}$) to reallocate. The proportion g of the number of B frames in $r_L$ to reallocate in this example may be calculated according to the expression:

$$g=f(n_{BL}-n_{BH})/n_{BL}.$$

For a case in which $n_{BH}$ is equal to zero (i.e., composite rate $r_H$ does not include any B frames), g is equal to f.

A decision of which frames to reallocate may be made nondeterministically. In one such example, a random variable (e.g., a uniformly distributed random variable) having a value R between 0 and 1 is evaluated for each of the frames that may be reallocated. If the current value of R is less than (alternatively, not greater than) the portion of frames to reallocate (e.g., g), then the frame is reallocated.

A decision of which frames to reallocate may be made deterministically. For example, the decision may be made according to some pattern. In a case where the portion of frames to reallocate is 5%, then the decision may be implemented to reallocate every $20^{th}$ reallocable frame to the new rate.

A decision of which frames to reallocate may be made according to a metric, such as a performance measure as cited herein. In one example, a reallocation decision is made based on how demanding or nondemanding is the corresponding portion of speech (i.e., how much perceptual or information content is present). Such a decision may be made in a closed-loop mode, in which results for a frame encoded at the two different rates are compared according to a metric (e.g., SNR). A reallocation decision may be made in an open-loop mode according to, for example, characteristics of the frame such as the type of waveform in the frame.

Figure 10A:
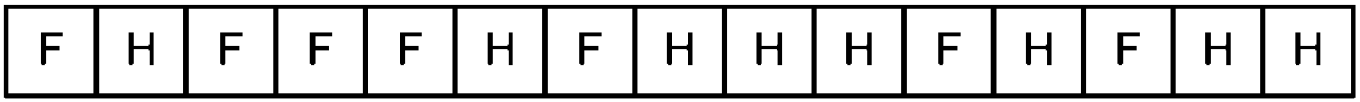
FIG. 10A shows an example of rates as applied to a series of frames by an encoder.

A speech encoder may be configured to use different coding modes to encode different types of active frames. For frames that are determined to contain transient speech, for example, the encoder may be configured to use a CELP mode. A speech encoder may also be configured to use different coding rates to encode different types of active frames. For frames that are determined to contain transient speech or beginnings of words (also called "up-transients"), for example, the encoder may be configured to use full-rate CELP. For frames that are determined to contain ends of words (also called "down-transients"), the encoder may be configured to use half-rate CELP. FIG. 10A shows one example of such rates as applied to a series of frames by an encoder configured in this manner.

Figure 10B:
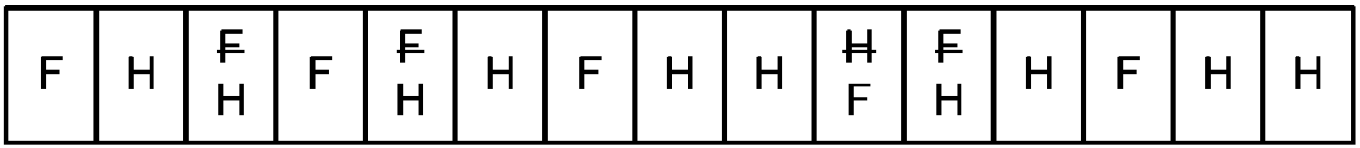
FIG. 10B shows an example in which the series of rates of FIG. 10A is altered to impose a repeating pattern.

An encoder may be configured to apply a composite rate using one or more rate patterns. For example, use of one or more rate patterns may allow an encoder to reliably achieve the average target rate associated with a particular composite rate. FIG. 10B shows an example in which the series of rates of FIG. 10A is altered to impose the repeating pattern (full-rate, half-rate, half-rate). A mechanism configured to impose such a pattern may include a coupling between (A) an open-loop decision process configured to classify the contents of each frame and (B) decision elements of the encoder that are configured to determine the rate of the encoded frame.

Figure 11A:
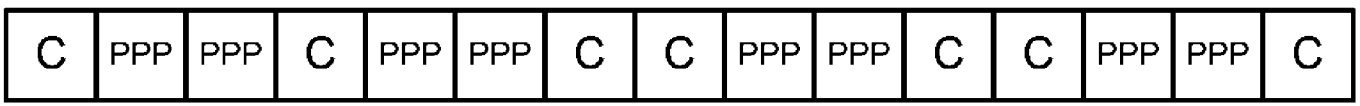
FIGS. 11A and 11B show examples of coding patterns imposed on series of frames.
Figure 11B:
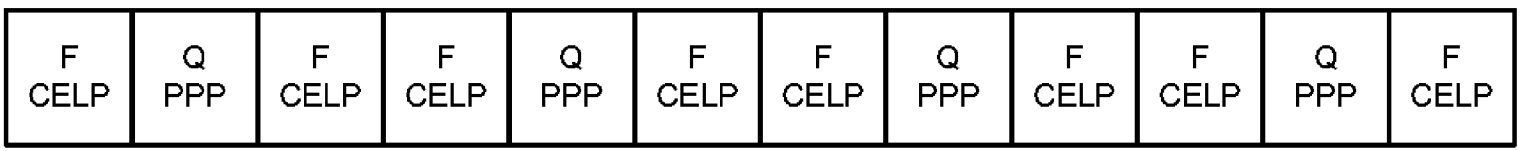

A rate pattern may also include two or more different coding modes. If the open-loop decision process determines that a series of frames contains voiced speech, for example, then the encoder may be configured to select from among PPP and CELP encoding modes. One criterion that may be used in such a selection is a degree of stationarity of the voiced speech. FIG. 11A shows one example of rates as applied to a series of frames by an encoder configured to select between CELP and the three-frame coding pattern (CELP, PPP, PPP), where C indicates CELP. FIG. 11B shows an example in which an encoder is configured to impose the coding pattern (full-rate CELP, quarter-rate PPP, full-rate CELP) on consecutive triplets of frames.

An encoder may be configured to use different sets of coding modes and rates according to which anchor point is selected. For example, one anchor point may associate speech, end-of-speech, and silence classifications to full-rate CELP, half-rate CELP, and silence encoding (e.g., eighth-rate NELP), respectively. Another anchor point may associate speech, end-of-speech, and silence classifications to full-rate CELP, quarter-rate PPP, and quarter-rate NELP, respectively.

Figure 12:
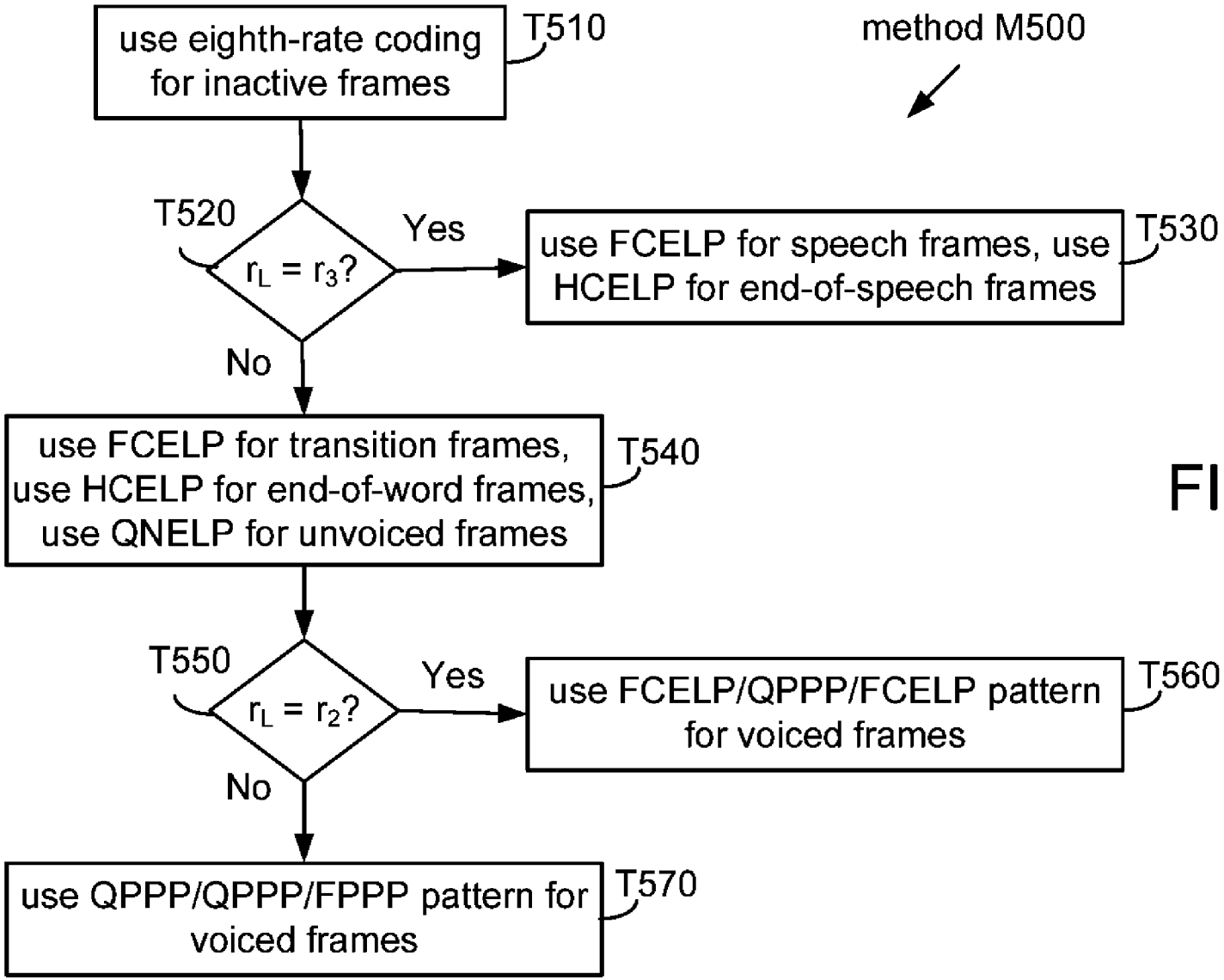
FIG. 12 shows a flowchart of a method M500 according to a configuration.

FIG. 12 shows one example of a method M500 that may be used to assign coding modes and rates according to a selected composite rate ("anchor point") $r_L$ for an encoder having a particular set of four composite rates $r_1<r_2<r_3<r_4$ as described above. Such a method may be used to implement selection of an anchor point by an implementation of task T430 or T440 as described above. In this example, task T510 assigns inactive frames (i.e., frames containing only background noise or silence) to an eighth-rate mode (e.g., eighth-rate NELP) for all anchor points. If task T520 determines that rate $r_3$ (also called "anchor operating point 0") is selected as anchor point $r_L$, then task T530 configures the encoder to use FCELP encoding for speech frames and HCELP encoding for end-of-speech frames. If either of rates $r_1$ and $r_2$ are selected are anchor point $r_L$, then task T540 configures the encoder to use FCELP encoding for transition frames, and HCELP encoding for end-of-word frames (also called "down-transients"), and QNELP encoding for unvoiced frames (e.g., fricatives).

If task T550 determines that rate $r_2$ (also called "anchor operating point 1") is selected as anchor point $r_L$, then task T560 configures the encoder to use the three-frame coding pattern (FCELP, QPPP, FCELP) for voiced frames. If rate $r_1$ (also called "anchor operating point 2") is selected as anchor point $r_L$, then task T570 configures the encoder to use the three-frame coding pattern (QPPP, QPPP, FCELP) for voiced frames. In one particular implementation of method M500, the corresponding set of composite rates ($r_1$, $r_2$, $r_3$, $r_4$) is (5750, 6600, 7500, 9000) kilobits per second (kbps). A similar arrangement of tasks may be used to implement a selected anchor point according to a different set of composite rates (e.g., having different coding patterns).

Figure 13:
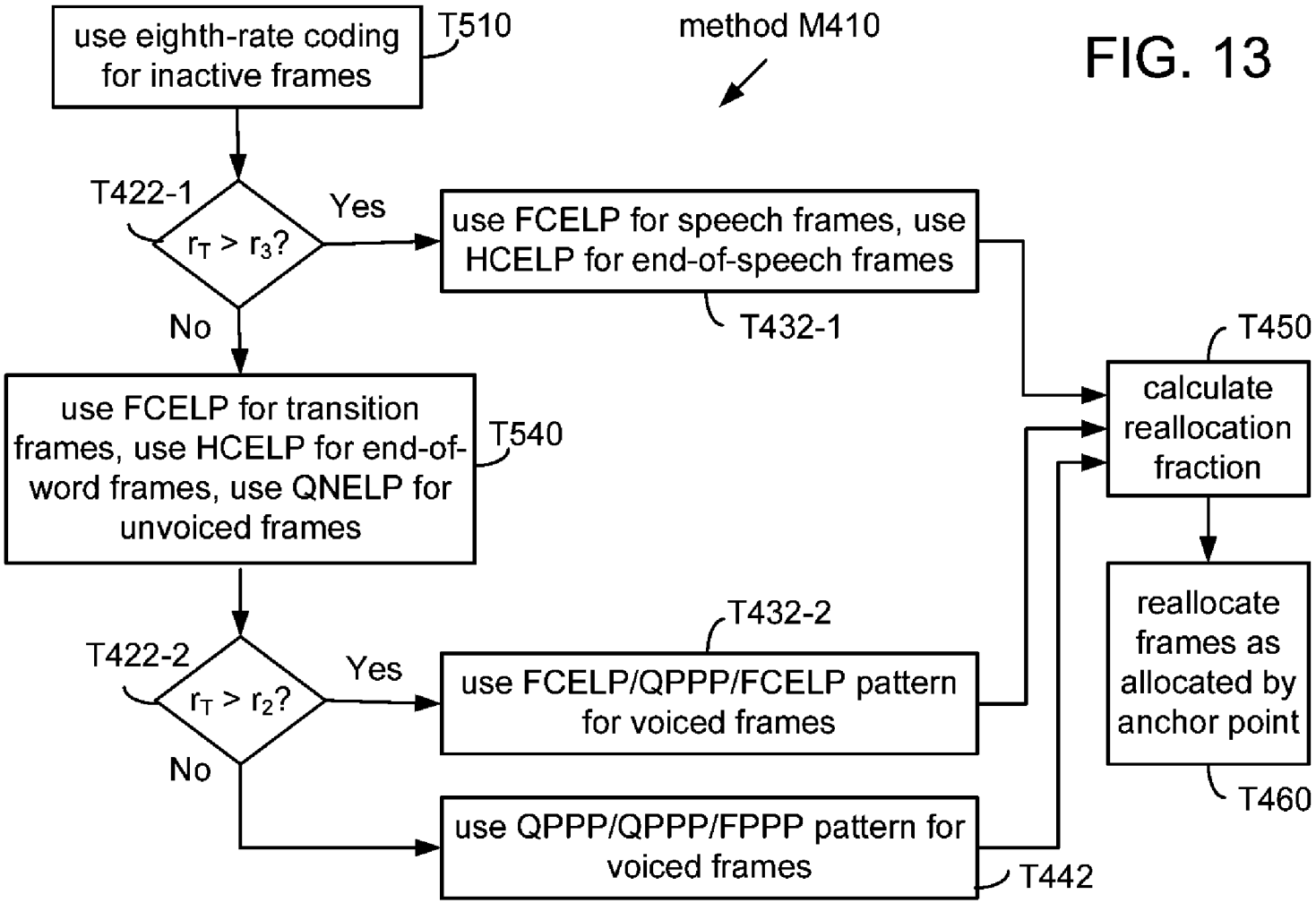
FIG. 13 shows a flowchart of an implementation M410 of method M400.

An implementation of method M400 may be configured to apply rate and/or mode assignments according to such a scheme. For example, FIG. 13 shows a flowchart of an implementation M410 of method M400 that assigns coding modes and rates according to the scheme of method M500. In this example, implementations T422 of task T420 determine the anchor point $r_L$; and task T540, implementations T432 of task T430, and/or implementation T442 of task T440 apply the appropriate coding modes.

Increased flexibility of a multi-mode, variable rate vocoder may be achieved by adjusting the rate control mechanism to achieve an arbitrary average target bit rate. For example, such a vocoder may be implemented to include various mechanisms that will allow it to individually adjust already-made coding and rate decisions. In some cases, a decision of which frames to reallocate may include changing a coding scheme or pattern as described above.

Figure 14:
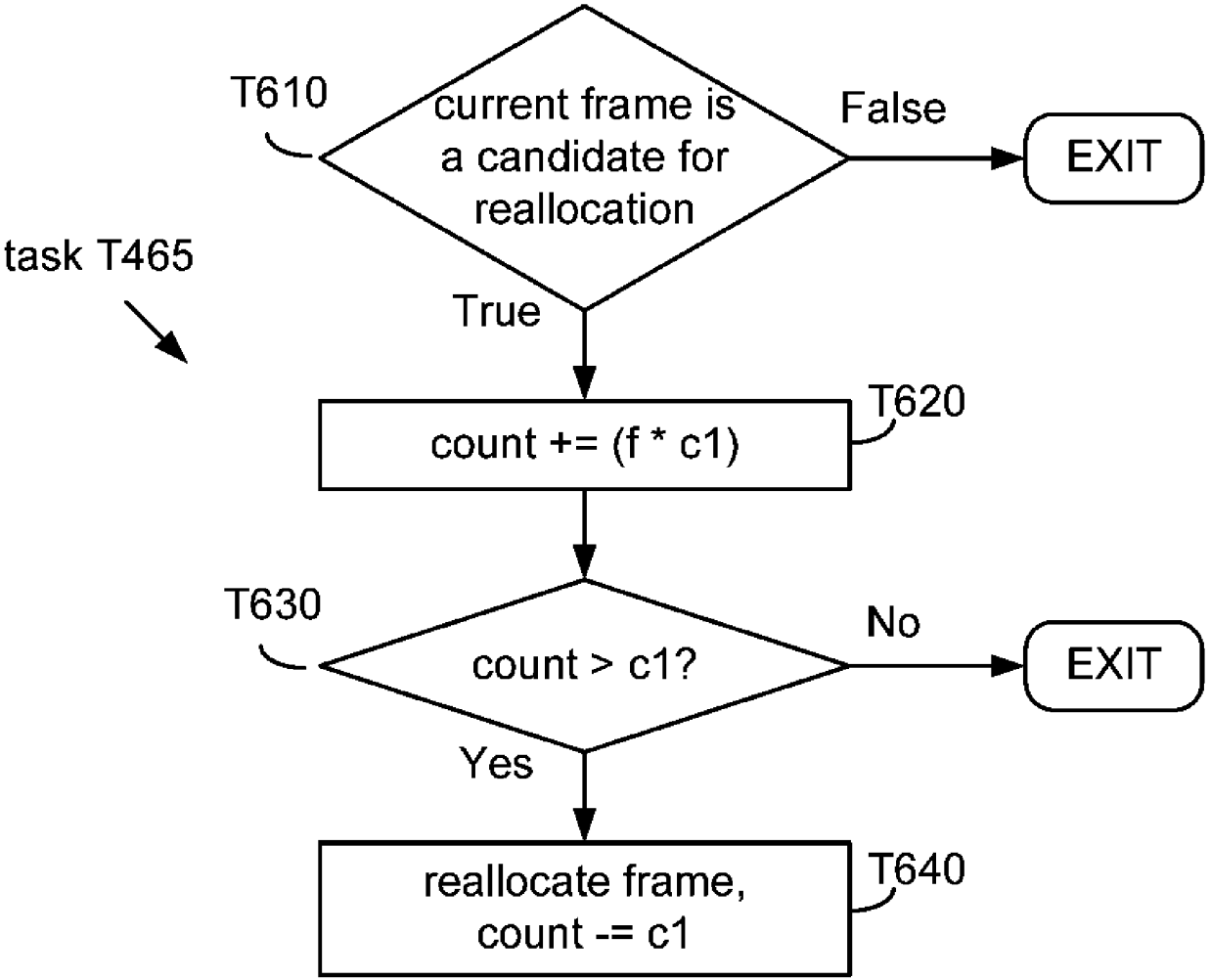
FIG. 14 shows a flowchart of an implementation T465 of task T460.

FIG. 14 shows a flowchart of an implementation T465 of task T460 that is configured to reallocate frames by changing a rate and/or mode assignment. Such a task is typically performed after an open-loop decision process (e.g., selection of an anchor rate $r_L$). In an encoder that includes a closed-loop decision process, such a task may be performed after an open-loop decision process and before closed-loop decision process. Alternatively, such a task may be performed after both of an open-loop decision process and a closed-loop decision process.

Task T610 determines whether the current frame is a candidate for reallocation. For example, if the reallocation fraction f indicates a reallocation of frames from component rate B to component rate D, then task T610 determines whether the current frame is assigned to component rate B.

In the particular example of method M410 as shown in FIG. 13, reallocation fraction f may indicate a reallocation of unvoiced (e.g., HCELP) frames to FCELP for anchor point $r_3$ (anchor operating point 0), a reallocation of QPPP frames to FCELP for anchor point $r_2$ (anchor operating point 1), and a reallocation of QPPP frames to FPPP or FCELP for anchor point $r_1$ (anchor operating point 2). In this case, task T610 may be configured to determine whether the current frame has been identified as unvoiced for anchor point $r_3$, and whether the current frame has been assigned to QPPP for anchor points $r_1$ and $r_2$.

It may be desired to further limit the pool of reallocation candidates. For a case in which more than one frame of a coding pattern may match a rate and/or mode selected for reallocation, task T610 may be configured to consider fewer than all of those frames. Such a limit may support a more uniform distribution of reallocations over time. In the particular example of method M410 as shown in FIG. 13, for anchor point $r_1$ (anchor operating point 2), it may be desired for task T610 to be configured to consider only one QPPP frame in each three-frame coding pattern (e.g., only the second QPPP frame) as a reallocation candidate. Such a configuration may be implemented by restricting task T610, for anchor point $r_1$, to consider a QPPP frame as a reallocation candidate only if the previous frame was also assigned to QPPP.

It will also be understood that when the pool of reallocation candidates is limited in such manner, it may become unnecessary to calculate the proportion g. In the example discussed immediately above, it is desired to reallocate f/2 of the QPPP frames in anchor point $r_1$. If all QPPP frames in $r_1$ were considered for reallocation, then it might be desirable to calculate a proportion g as described above (here, g would be equal to f/2) and to reallocate frames according to that proportion. Because of the limit being applied to the pattern, however, only half of the QPPP frames in anchor point $r_1$ are considered for reallocation. Applying the reallocation fraction f to this reduced pool thus yields the same number of reallocations as applying the proportion g to all QPPP frames in $r_1$. In terms of the expression for g set forth above [$g=f(n_{BL}-n_{BH})/n_{BL}$], such a limit effectively alters the value of $n_{BH}$ and/or $n_{BL}$ with respect to application of the reallocation fraction f. In the example of applying a limit as discussed immediately above, that is to say, the value of $n_{BH}$ is effectively zero, such that g is equal to f and calculation of g is unnecessary.

Task T620 increments a counter according to the reallocation fraction f. In the example of FIG. 14, task T620 increments the counter by the product of f and a factor c1. Task T630 compares the value of the counter to the factor c1. If the value of the counter is greater than c1, then the value of the counter is decremented by c1 and the current frame is reallocated to the destination component rate and/or mode. In this example, tasks T620, T630, and T640 operate as a counter modulo c1 configured to initiate a reallocation of the current frame upon a rollover of the counter.

Figure 15A:
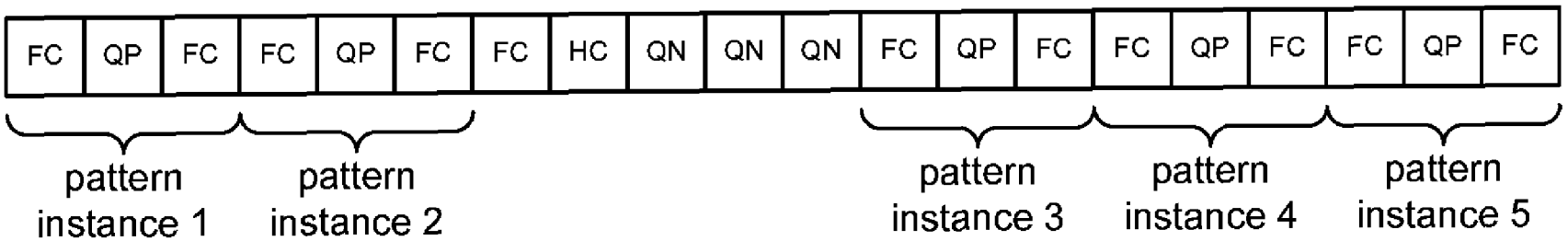
FIGS. 15A and 15B show examples of a series of frame assignments before and after reallocation.
Figure 15B:
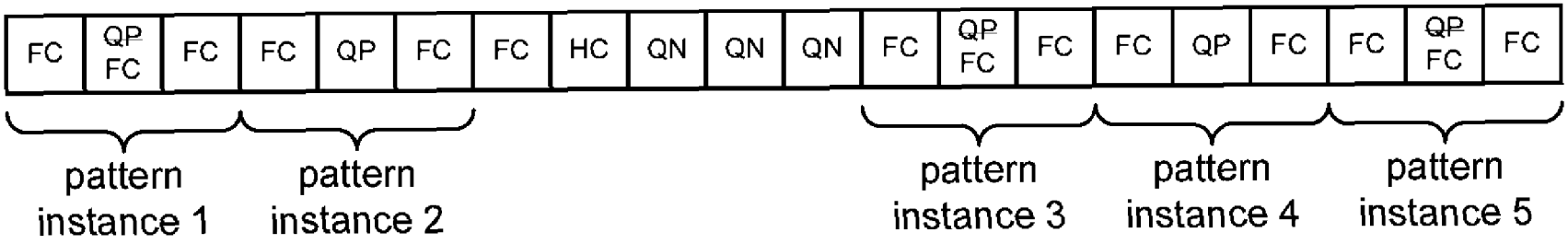

FIG. 15A shows one example of a series of frames encoded according to the composite rate $r_2$ as shown in FIGS. 12 and 13. In this figure, FC, QP, HC, and QN denote FCLP, QPPP, HCLP, and QNELP, respectively. FIG. 15B shows one example of the same series after a reallocation operation according to a fraction f of about 50%.

It may be desired to alter the reallocation ratio (e.g., temporarily) without changing or recalculating the reallocation fraction f. FIG. 16A shows a flowchart of an implementation T466 of task T465 that may be used in such a case. This implementation uses a different constant c2 in implementations T632 and T642 of tasks T630 and T640, respectively. In such manner, the effective reallocation ratio may be changed from f to (f/R), where c2=R*c1, and R is any positive nonzero number. For example, c2 may have a value of 2*c1 (effectively reducing the reallocation ratio to f/2) or 4*c1 (effectively reducing the reallocation ratio to f/4).

Configurations as described above may be implemented along with already-existing (or equivalents to already-existing) mode decision-making processes present in some variable rate coders. Based on a set of thresholds and decisions, a first rate decision is made for each frame so that the vocoder can match the rate of the lower initial composite rate (anchor point). Based on the arbitrary target average rate $r_T$, a certain fraction of frames is selected to be sent (i.e., reallocated) from a lower component rate to a higher component rate (e.g., according to a configuration as described above). Alternatively, a first rate decision is made for each frame so that the vocoder can match the rate of the higher initial composite rate, and a certain fraction of frames is selected to be sent from a higher component rate to a lower component rate, based on the arbitrary target average rate $r_T$.

A second decision may then be made to identify which of the individual lower rate frames are to remain at the lower component rate (or alternatively, which of the individual higher rate frames are to remain at the higher component rate). As described above, this second decision may be performed through any of several different ways. In one configuration, a uniform random variable between 0 and 1 is used to map the second decision by obtaining a value for the random variable and then determining whether this value of the uniform random variable is less than or greater than the above-mentioned fraction f. In another configuration, the frames that are to be reallocated are deterministically selected.

Configurations as described above may be used to implement a process for achieving an arbitrary average data rate, wherein the arbitrary average data rate may be any target average rate set by a user, by a network, and/or by channel conditions. In addition, the above configurations may also be used in conjunction with a dynamically changing average data rate. For example, the average data rate may change over the short term according to variations in speech behavior (e.g., changes in the proportion of voiced to unvoiced frames). The average data rate may also dynamically change in situations such as an active communication session where a user is moving rapidly within the coverage of a base station. A mobile environment, and other situations causing deep fades, would dramatically alter the average data rates, so a mechanism for minimizing the deleterious effects of such an environment is provided below.

In some configurations of a rate selection task (e.g., task T310 or T410), a short sequence of frames is used to dynamically alter the target average rate so that the overall target average bit-rate can be achieved effectively. First, consider a sequence of Y frames, where Y is much less than N. For each group of Y encoded frames as outputted by the encoder, the actual average rate $r_Y$ is calculated. For example, for every number of Y frames (e.g., for each one of m groups of Y frames), the average rate $r_Y$ may be measured using the first set of decisions as described above (e.g., rate assignment according to a selected anchor point) and then using the second decision process (e.g., reallocation). As noted above, this rate $r_Y$ may differ from the desired arbitrary average data rate $r_T$.

In such a configuration, a new target $r_{TT}$ is computed as a function of the original arbitrary average data rate $r_T$, and the actual average rate over the previous group of Y frames $r_Y$. The new target rate $r_{TT}$ may be calculated according to an expression such as:

$$r_{TT}=q*r_T-r_Y.$$

where the factor q typically has a value of two. In another example, factor q has a value slightly less than two (e.g., 1.8, 1.9, 1.95, or 1.98). It may be desired to use a value of q that is less than two to avoid overshooting the desired arbitrary average rate $r_T$.

This $r_{TT}$ value is then used as the target $r_T$ used for calculating the reallocation fraction for the next Y frames. Such an operation may continue groupwise into the next set of N frames, or may be reset before being performed on the next set of N frames.

A configuration of a rate selection task as described herein may be applied to obtain dynamic rate adjustment. For example, it may be desired to maintain the arbitrary average target data rate $r_T$ as an average rate over time (e.g., a running average). One such method calculates the current average rate $r_Y$ over some set of Y frames (e.g., one hundred frames) and evaluates how much of the available rate remains.

For example, an average rate $r_Y$ for a two-second period (about 100 frames) may be calculated. It may be expected that the communication, such as a telephone call, will last several minutes (e.g., that N may be equal to several thousand). Assume that the target rate is 4 kbps, and that the rate calculated for the most recent 100 frames was 3.5 kbps. In such case, a new average rate $r_T$ of 4.5 kbps may be used for processing the next 100 frames, at which time the process of calculating $r_Y$ for the most recent Y frames and evaluating $r_{TT}$ may be repeated. In other examples, it may be desired to use a larger value of Y (e.g., 400 or 600 frames), as such a value may help to prevent anomalies such as a long duration of unvoiced speech (e.g., a drawn out "s" sound) from distorting the average rate statistic. In general, the system may be tuned to achieve a desired average rate by using short-term average target rates $r_{TT}$ to obtain a desired arbitrary average rate $r_T$ in the long term.

In such an example, the transmitter (e.g., mobile phone) may also receive a new command to increase its rate. From then on, the short-term average $r_{TT}$ may be adjusted based on that new target $r_T$, such that an adjustment to the new rate may be made substantially instantaneously.

Figure 16B:
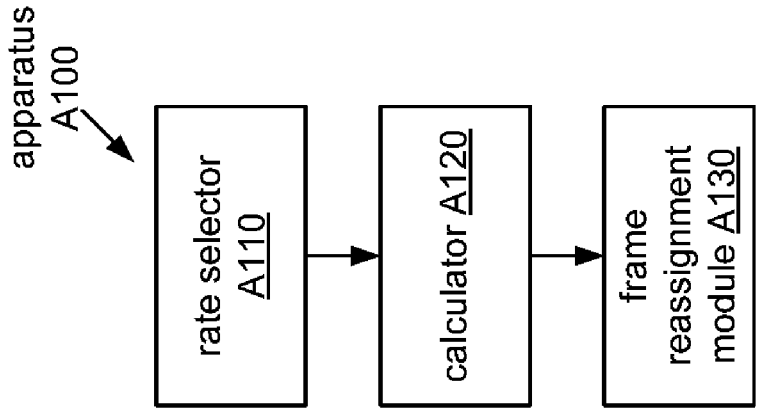
FIG. 16B shows a block diagram of an apparatus A100 according to a configuration.
Figure 16A:
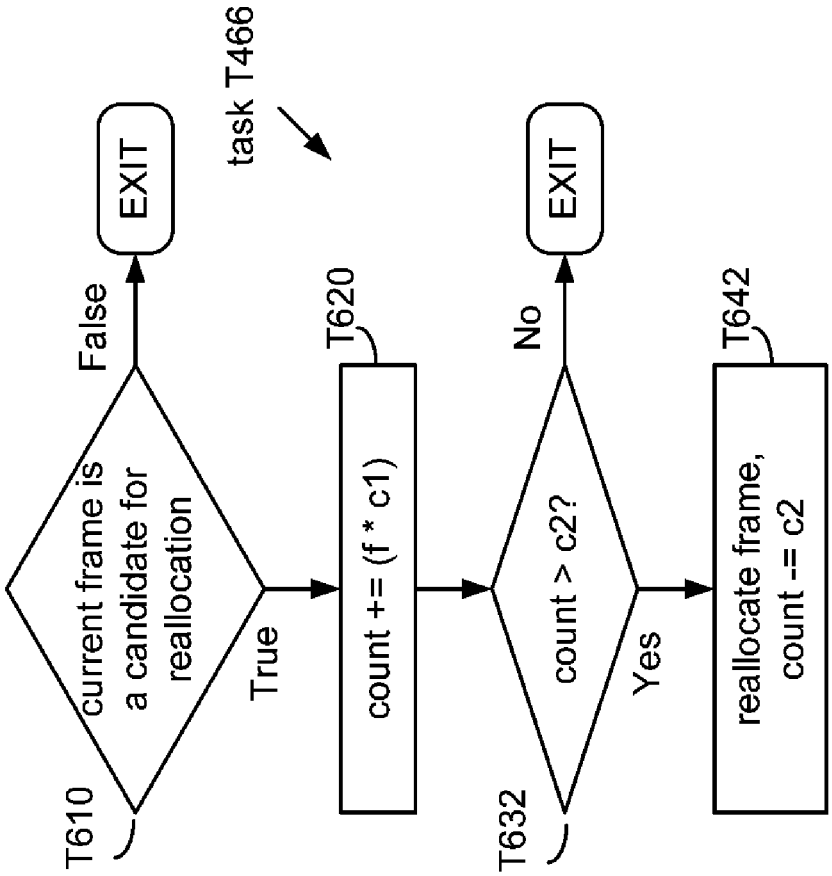
FIG. 16A shows a flowchart of an implementation T466 of task T465.

FIG. 16B shows a block diagram of an apparatus A100 according to a general configuration. Rate selector A110 is configured to select, based on a target rate, a composite rate from among a set of composite rates. Each of the set of composite rates includes a first allocation of frames to a first component rate of the selected composite rate and a second allocation of frames to a second component rate of the selected composite rate. For example, rate selector A110 may be configured to perform an implementation of tasks T320-T330, or of tasks T420-T430, or of tasks T420-T440, as disclosed herein. Calculator A120 is configured to calculate a reallocation fraction based on the target rate and the selected composite rate. For example, calculator A120 may be configured to perform an implementation of task T340 or T450 as disclosed herein. Frame reassignment module A130 is configured to reallocate (i.e., reassign), based on the reallocation fraction and the first allocation of the selected composite rate, frames from the first component rate of the selected composite rate to the second component rate of the selected composite rate. For example, frame reassignment module A130 may be configured to perform an implementation of task T350 or task T460 as disclosed herein.

The various elements of apparatus A100 may be implemented in any combination of hardware (e.g., one or more arrays of logic elements) with software and/or firmware that is deemed suitable for the intended application. For example, frame reassignment module A130 may be implemented as a pattern modifier as described below. A capacity operating point tuner as described below may be implemented to include rate selector A110 and calculator A120. In some implementations, the various elements reside on the same chip or on different chips of a chipset. Such an apparatus may be implemented as part of a device such as a speech encoder, a codec, or a communications device such as a cellular telephone as described herein. Such an apparatus may also be implemented in whole or in part within a network configured to communicate with such communications devices, such that the network is configured to calculate and send reassignment instructions (such as one or more values of a reallocation fraction) to the devices according to tasks as described herein.

The above configurations can be used together to arbitrarily change the average data rates for variable rate coders. However, the use of such configurations has more profound implications for the communication networks that service such improved variable rate coders. The system capacity of a network is limited by the number of users sending voice and data over-the-air. The above configurations may be used by the network operators to fine tune the load upon the network when trading off quality versus capacity.

In general, higher quality speech signals are reconstructed with a greater number of bits. More data bits in each communication channel means that the network has less channels to allocate to users. Likewise, low quality speech signals are reconstructed with fewer bits. Less data bits in each communication channel means that the network has more channels to allocate to users. Hence, the configurations described above may be used by a network operator to change the capacity in a more controlled manner than previously existed. Such configurations may be used to permit the network operators to implement arbitrary capacity operating points for the system. Hence, the configurations may be implemented to have a two-fold functionality. The first functionality is to achieve arbitrary average data rates for the variable rate coders and the second functionality is to achieve arbitrary capacity operating points for a network that supports such improved variable rate coders.

Those of skill in the art would understand that the various illustrative logical blocks and algorithm tasks described in connection with the configurations disclosed herein may be implemented or performed with an array of logic elements such as a digital signal processor (DSP) or an application specific integrated circuit (ASIC); discrete gate or transistor logic; discrete hardware components such as, e.g., registers and a first-in-first-out (FIFO) buffer; a processor executing a set of firmware instructions; or any conventional programmable software module and a processor. The processor may advantageously be a microprocessor, but in the alternative, the processor may be any conventional (or equivalent) processor, controller, microcontroller, or state machine. The software module could reside as code and/or data in random-access memory (RAM), flash memory, registers, or any other form of computer-readable medium (e.g., readable and/or writable storage medium) known in the art. Those of skill would further appreciate that the data, instructions, commands, information, signals, bits, symbols, and chips that may be referenced throughout the above description are advantageously represented by voltages, currents, electromagnetic waves, magnetic fields or particles, optical fields or particles, or any combination thereof.

Figure 17A:
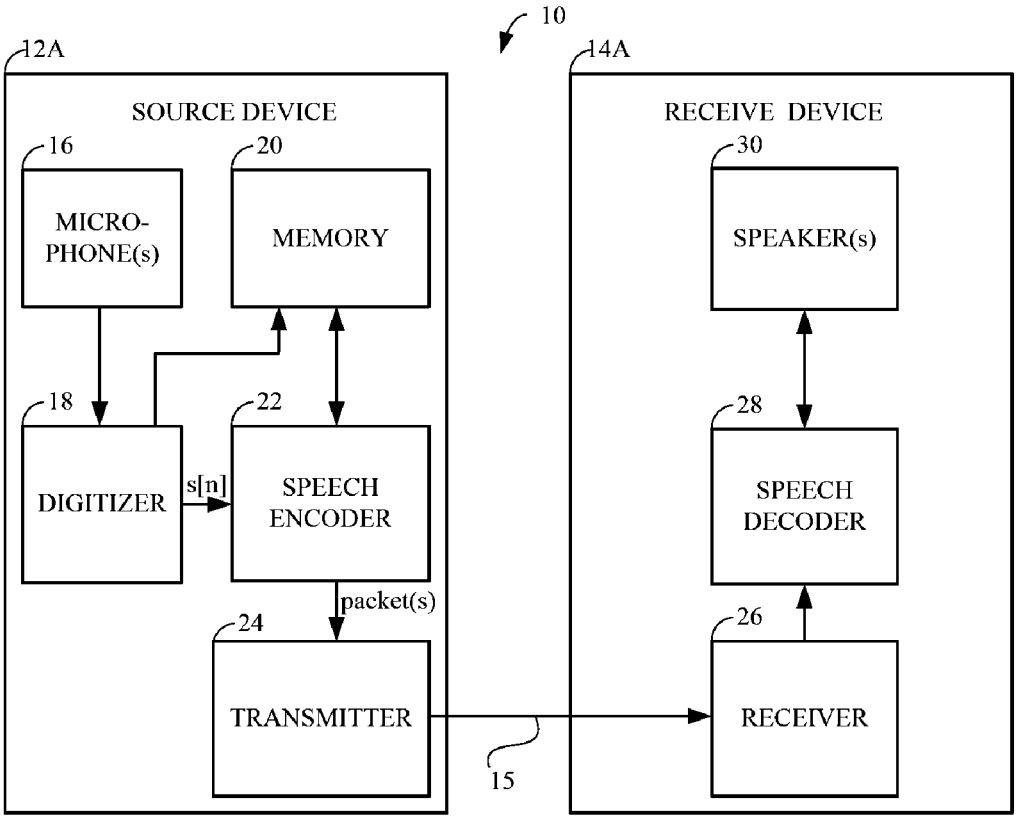
FIG. 17A is a block diagram illustrating an example system in which a source device transmits an encoded bit-stream to a receive device.

For example, the following section (with reference to FIGS. 17A to 26) includes descriptions of additional configurations of methods as described above and of apparatus configured to perform implementations of such methods:

FIG. 17A is a block diagram illustrating an example system 10 in which a source device 12*a* transmits an encoded bitstream via communication link 15 to receive device 14*a*. The bitstream may be represented as one or more packets. Source device 12*a* and receive device 14*a* may both be digital devices. In particular, source device 12*a* may encode speech data consistent with the 3GPP2 EVRC-B standard, or similar standards that make use of encoding speech data into packets for speech compression. One or both of devices 12*a*, 14*a* of system 10 may implement selection of encoding modes (based on different coding models) and encoding rates for speech compression, as described in greater detail below, in order to improve the speech encoding process.

Communication link 15 may comprise a wireless link; a physical transmission line; fiber optics; a packet-based network such as a local area network, wide-area network, or global network such as the Internet; a public switched telephone network (PSTN); or any other communication link capable of transferring data. The communication link 15 may be coupled to a storage media. Thus, communication link 15 represents any suitable communication medium, or possibly a collection of different networks and links, for transmitting compressed speech data from source device 12*a* to receive device 14*a*.

Source device 12*a* may include one or more microphones 16 which captures sound. The continuous sound, s(t) is sent to digitizer 18. Digitizer 18 samples s(t) at discrete intervals and produces a quantized (digitized) speech signal, represented by s[n]. The digitized speech, s[n] may be stored in memory 20 and/or sent to speech encoder 22 where the digitized speech samples may be encoded, often over a 20 ms (160 samples) frame. The encoding process performed in speech encoder 22 produces one or more packets, to send to transmitter 24, which may be transmitted over communication link 15 to receive device 14*a*. Speech encoder 22 may include, for example, various hardware, software or firmware, or one or more digital signal processors (DSPs) that execute programmable software modules to control the speech encoding techniques, as described herein. Associated memory and logic circuitry may be provided to support the DSP in controlling the speech encoding techniques. As will be described, speech encoder 22 may perform more robustly if encoding modes and rates may be changed prior and/or during encoding at arbitrary target bit rates.

Receive device 14*a* may take the form of any digital audio device capable of receiving and decoding audio data. For example, receive device 14*a* may include a receiver 26 to receive packets from transmitter 24, e.g., via intermediate links, routers, other network equipment, and like. Receive device 14*a* also may include a speech decoder 28 for decoding the one or more packets, and one or more speakers 30 to allow a user to hear the reconstructed speech, s'[n], after decoding of the packets by speech decoder 28.

Figure 17B:
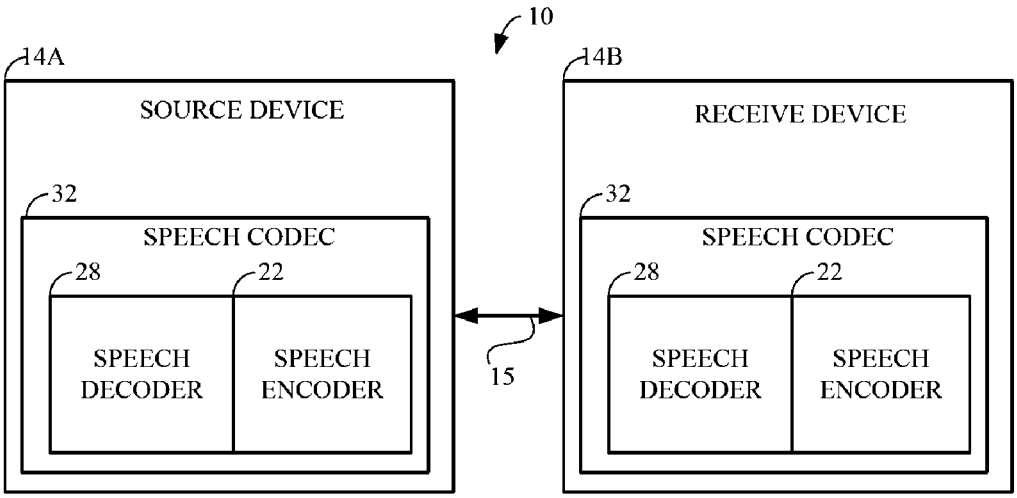
FIG. 17B is a block diagram of two speech codecs that may be used as described in a configuration herein.

In some cases, a source device 12*b* and receive device 14*b* may each include a speech encoder/decoder (codec) 32 as shown in FIG. 17B, for encoding and decoding digital speech data. In particular, both source device 12*b* and receive device 14*b* may include transmitters and receivers as well as memory and speakers. Many of the encoding techniques outlined below are described in the context of a digital audio device that includes an encoder for compressing speech. It is understood, however, that the encoder may form part of a speech codec 32. In that case, the speech codec may be implemented within hardware, software, firmware, a DSP, a microprocessor, a general purpose processor, an application specific integrated circuit (ASIC), a field programmable gate array (FPGA), discrete hardware components, or various combinations thereof.

Figure 18:
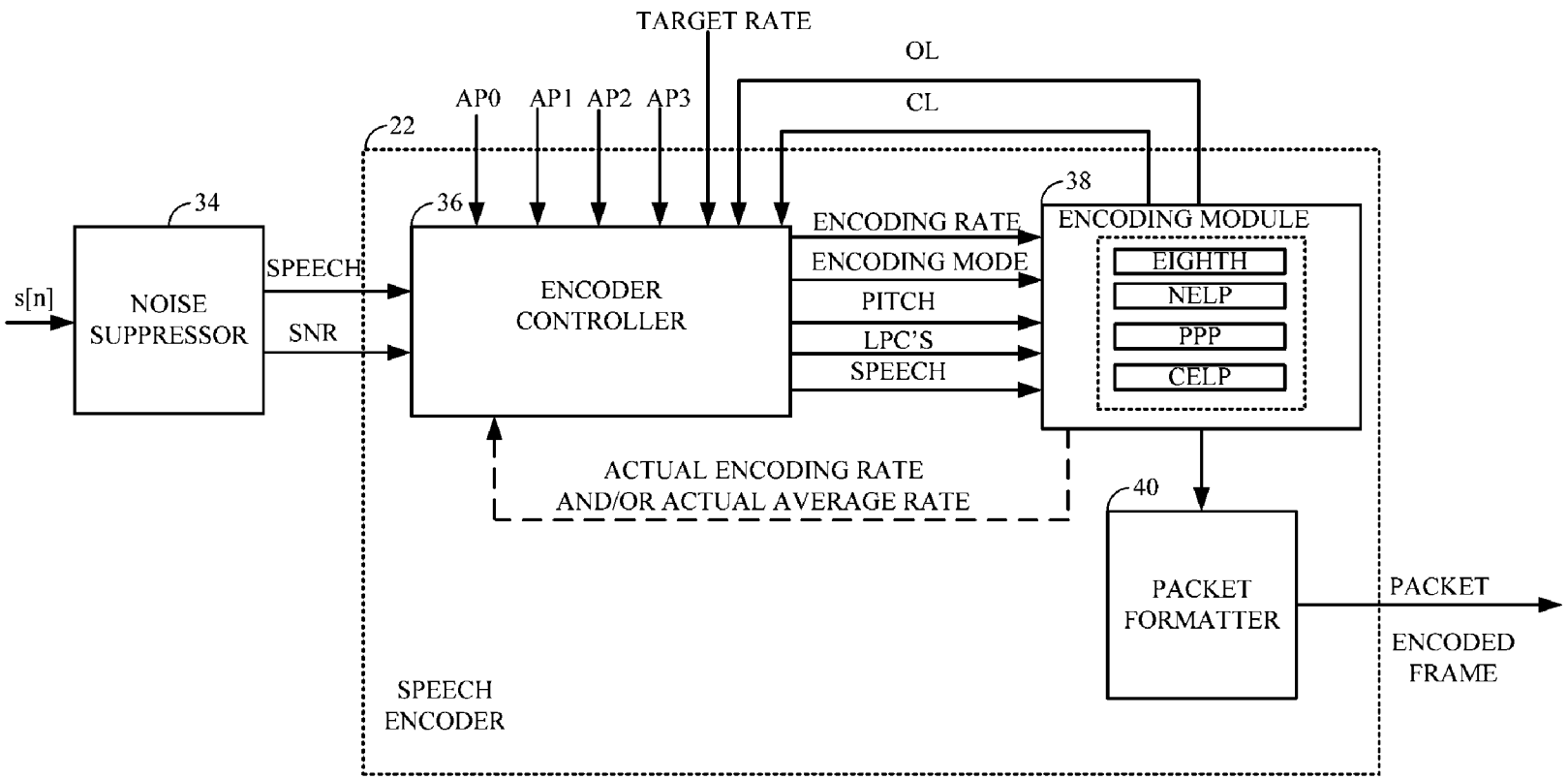
FIG. 18 is an exemplary block diagram of a speech encoder that may be used in a digital device illustrated in FIG. 17A or FIG. 17B.

FIG. 18 illustrates an exemplary speech encoder that may be used in a device of FIG. 17A or FIG. 17B. Digitized speech, s[n] may be sent to a noise suppressor 34 which suppresses background noise. The noise suppressed speech (referred to as speech for convenience) along with signal-to-noise-ratio (snr) information derived from noise suppressor 34 may be sent to speech encoder 22. Speech encoder 22 may comprise a encode controller 36, and encoding module 38 and packet formatter 40. Encoder controller 36 may receive as input fixed target bit rates, or target average bit rates which serve as anchor points, and open-loop (ol) re-decision and closed loop (cl) re-decision parameters. Encoder controller 36 may also receive the actual encoded bit rate (i.e., the bit rate at which the frame was actually encoded). The actual or weighted actual average bit rate may also be received by encoder controller 36 and calculated over a window (ratewin) of pre-determined number of frames, W. As an example, W may be 600 frames. A ratewin window may overlap with a previous ratewin window, such that the actual average bit rate is calculated more often than W frames. This may lead to a weighted actual average bit rate. A ratewin window may also be non-overlapping, such that the actual average bit rate is calculated every W frames.

The number of anchor points may vary. In one aspect, the number of anchor points may be four (ap0, ap1, ap2, and ap3). In one aspect, the ol and cl parameters may be status flags to indicate that prior to encoding or during encoding that an encoding mode and/or encoding rate change may be possible and may improve the perceived quality of the reconstructed speech. In another aspect, encoder controller 36 may ignore the ol and cl parameters. The ol and cl parameters may be used independently or in combination. In one configuration, encoder controller 36 may send encoding rate, encoding mode, speech, pitch information and linear predictive code (lpc) information to encoding module 38. Encoding module 38 may encode speech at different encoding rates, such as eighth rate, quarter rate, half rate and full rate, as well as various encoding modes, such as code excited linear predictive (CELP), noise excited linear predictive (NELP), prototype pitch period (PPP) and/or silence (typically encoded at eighth rate). These encoding modes and encoding rates are decided on a per frame basis. As indicated above, there may be open loop re-decision and closed loop re-decision mechanisms to change the encoding mode and/or encoding rate prior or during the encoding process.

Figure 19:
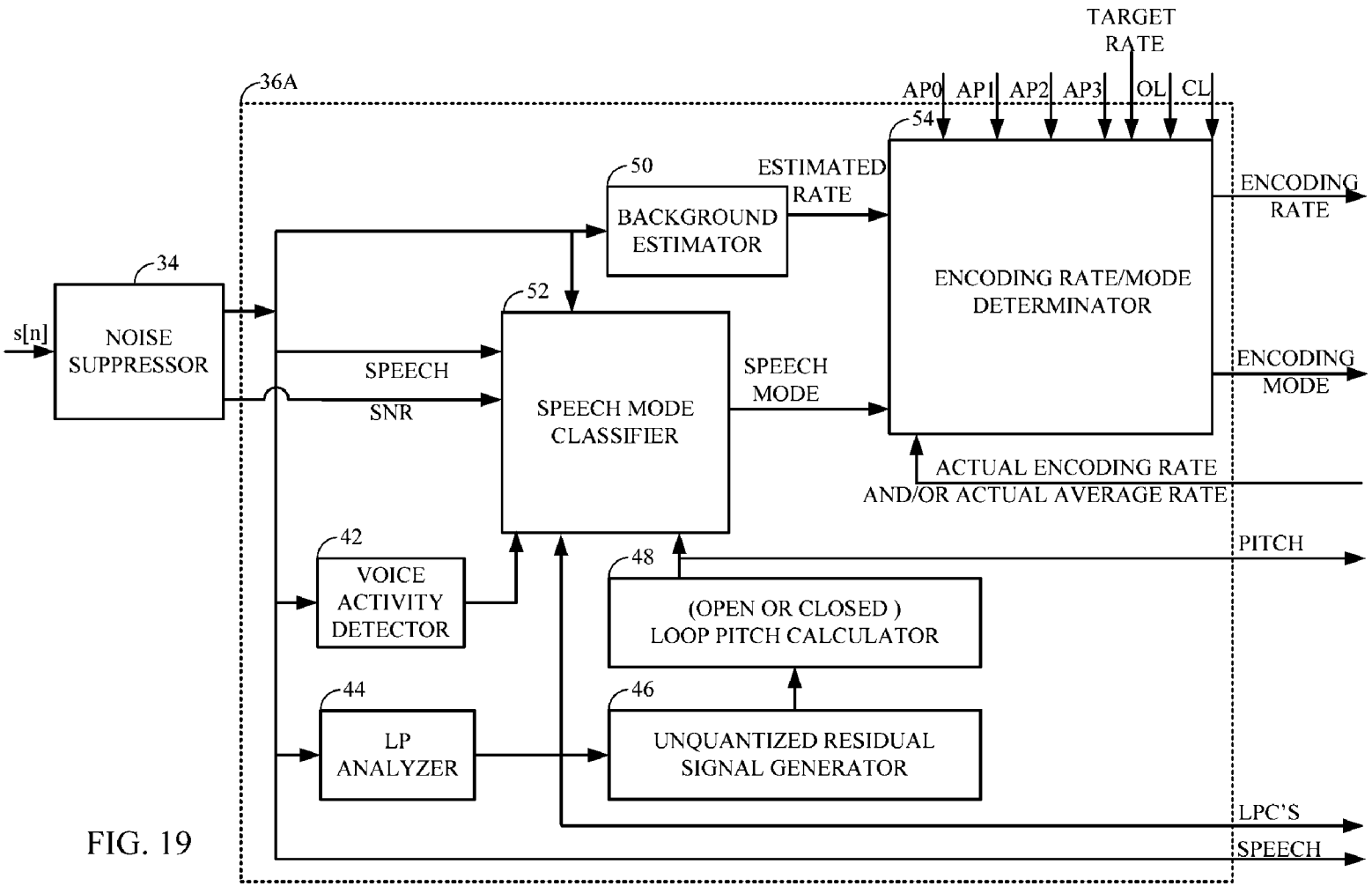
FIG. 19 illustrates details of an exemplary encoding controller 36A.

FIG. 19 illustrates details of an exemplary encoding controller 36A. In one configuration, speech and snr information may be sent to encoding controller 36A. Encoding controller 36A may comprise a voice activity detector 42, lpc analyzer 44, un-quantized residual generator 46, loop pitch calculator 48, background estimator 50, speech mode classifier 52, and encoding mode/rate determinator 54. Voice activity detector (vad) 42 may detect voice activity and in some configurations perform coarse rate estimation. Lp analyzer 44 may generate lp (linear predictive) analysis coefficients which may be used to represent an estimate of the spectrum of the speech over a frame. A speech waveform, such as s[n], may then be passed into a filter that uses the lp coefficients to generate an un-quantized residual signal in un-quantized residual signal generator 46. It should be noted that the residual signal is called "un-quantized" to distinguish initial analog-to-digital scalar quantization (the type of quantization that typically occurs in digitizer 18) from further quantization. Further quantization is often referred to as compression.

The residual signal may then be correlated in loop pitch calculator 48 and an estimate of the pitch frequency (often represented as a pitch lag) is calculated. Background estimator 50 estimates possible encoding rates as eighth-rate, half-rate or full-rate. In some configurations, speech mode classifier 52 may take as inputs pitch lag, vad decision, lpc's, speech, and snr to compute a speech mode. In other configurations, speech mode classifier 52 may have a background estimator 50 as part of it's functionality to help estimate encoding rates in combination with speech mode. Whether speech mode and estimated encoding rate are output by background estimator 50 and speech mode classifier 52 separately (as shown) or speech mode classifier 52 outputs both speech mode and estimated encoding rate (in some configurations), encoding rate/mode determinator 54 may take as inputs an estimated rate and speech mode and may output encoding rate and encoding mode as part of its output. Those of ordinary skill in the art will recognize that there are a wide array of ways to estimate rate and classify speech. Encoding rate/mode determinator 54 may receive as input fixed target bit rates, which may serve as anchor points. For example, there may be four anchor points, ap0, ap1, ap2 and ap3, and/or open-loop (ol) re-decision and closed loop (cl) re-decision parameters. As mentioned previously, in one aspect, the ol and cl parameters may be status flags to indicate prior to encoding or during encoding that an encoding mode and/or encoding rate change may be required. In another aspect, encoding rate/mode determinator 54 may ignore the ol and cl parameters. In some configurations, ol and cl parameters may be optional. In general, the ol and cl parameters may be used independently or in combination.

An exemplary encoding rate/mode determinator 54A is illustrated in FIG. 20. Encoding rate/mode determinator 54A may comprise a mapper 70 and dynamic encoding mode/rate determinator 72. Mapper 70 may be used for mapping speech mode and estimated rate to a "suggested" encoding mode (sem) and "suggested" encoding rate (ser). The term "suggested" means that the actual encoding mode and actual encoding rate may be different than the sem and/or ser. For exemplary purposes, dynamic encoding mode/rate determinator 72 may change the suggested encoding rate (ser) and/or the suggested encoding mode (sem) to a different encoding mode and/or encoding rate. Dynamic encoding mode/rate determinator 72 may comprise a capacity operating point tuner 74, a pattern modifier 76 and optionally an encoding rate/mode overrider 78. Capacity operating point tuner 74 may use one or more input anchor points, the actual average rate, and a target rate (that may be the same or different from the input anchor points) to determine a set of operating anchor points. If non-overlapping ratewin windows are used, M may be equal to W. As such, in an exemplary configuration, M may be around 600 frames. It is desired that M be large enough to prevent duration of unvoiced speech, such as drawn out "s" sounds from distorting the average bit rate calculation. Capacity operating point tuner 74 may generate a fraction (p_fraction) of frames to potentially change the suggested encoding mode (sem)/and or suggested encoding rate (ser) to a different sem and/or ser.

Pattern modifier 76 outputs a potentially different encoding mode and encoding rate than the sem and ser. In configurations where encoding rate/mode overrider 78 is used, ol re-decision and cl re-decision parameters may be used. Decisions made by encoding controller 36A through the operations completing pattern modifier 76 may be called "open-loop" decisions. In other words, the encoding mode and encoding rate output by pattern modifier 76 (prior to any open or closed loop re-decision (see below)) may be an open loop decision. Open loop decisions performed prior to compression of at least one of either amplitude components or phase components in a current frame and performed after pattern modifier 76 may be considered open-loop (ol) re-decisions.

Re-decisions are named as such because a re-decision (open loop and/or closed loop) has determined if encoding mode and/or encoding rate may be changed to a different encoding mode and/or encoding rate. These re-decisions may be one or more parameters indicating that there was a re-decision to change the sem and/or ser to a different encoding mode or encoding rate. If encoding mode/rate overrider 78 receives an ol re-decision, the encoding mode and/or encoding rate may be changed to a different encoding mode and/or encoding rate. If a re-decision (ol or cl) occurs the patterncount (see FIG. 20) may be sent back to pattern modifier 76, and via override checker 108 (see FIG. 23) the patterncount may be updated. Closed loop (cl) re-decisions may be performed after compression of at least one of either amplitude components or phase components in a current frame may involve some comparison involving variants of the speech signal. There may be other configurations, where encoding rate/mode overrider 78 is located as part of encoding module 38. In such configurations, there may not need to be any repeating of any prior encoding process, as a switch in the encoding process may be performed to accommodate for the re-decision to change encoding mode and/or encoding rate. A patterncount (see FIG. 23) may still be kept and sent to pattern modifier 76, and override checker 108 (see FIG. 23) may then aid in updating the value of patterncount to reflect the re-decision.

FIG. 21 is an illustration of a method to map speech mode and estimated rate to a suggested encoding mode (sem) and suggested encoding rate (ser). Routing of speech mode to a desired encoding mode/rate map 80 may be carried out. Depending on operating anchor point (op_ap0, op_ap1, or op_ap2) there may be a mapping of speech mode and estimated rate (via rate_h__1, see below) to encoding mode and encoding rate 82/84/86. The estimated rate may be converted from a set of three values (eighth-rate, half-rate, and full-rate) to a set of two values, low-rate or high-rate 88. Low-rate may be eighth-rate and high-rate may be not eighth-rate (e.g., either half-rate or full-rate is high-rate). Low-rate or high-rate is represented as rate_h__1. Routing of op_ap0, op_ap1 and op_ap2 to desired encoding rate/encoding mode map 90 selects which map may be used to generate a suggested encoding mode (sem) and/or suggested encoding rate (ser).

FIG. 22 is an exemplary illustration of a method to map speech mode and estimated rate to a suggested encoding mode (sem) and suggested encoding rate (ser). Exemplary speech modes may be down-transient, voiced, transient, up-transient, unvoiced and silence. Depending on operating anchor point, the speech modes may be routed 80A and mapped to various encoding rates and encoding modes. In this exemplary illustration, exemplary operating anchor points op_ap0, op_ap1, and op_ap2 may loosely be operating over "high" bit rate (op_ap0), "medium" bit rate (op_ap1), and "low" bit rate (op_ap2). High, medium, and low bit rates, as well as specific numbers for the anchor points may vary depending on the capacity of the network (e.g., WCDMA) at different times of the day and/or region. For operating anchor point zero, op_ap0, an exemplary mapping 82A is shown as follows: speech mode "silence" may be mapped to eighth-rate silence; speech mode "unvoiced" may be mapped to quarter-rate NELP; all other speech modes may be mapped to full-rate CELP. For operating anchor point one, op_ap1, an exemplary mapping 84A is shown as follows: speech mode "silence" may be mapped to eighth-rate silence; speech mode "unvoiced" may be mapped to quarter-rate nelp if rate_h__1 92 is high, and may be mapped to eighth-rate silence if rate_h__1 92 is low; speech mode "voiced" may be mapped to quarter-rate PPP (or in other configurations half-rate, or full rate); speech modes "up-transient" and "transient" may be mapped to full-rate CELP; speech mode "down-transient" may be mapped to full-rate CELP if rate_h__1 92 is high and may be mapped to half-rate CELP if rate_h__1 92 is low. For operating anchor point two, op_ap2, the exemplary mapping 86A may be as was described for op_ap1. However, because op_ap2 may be operating over lower bit rates, the likelihood that speech mode voiced may be mapped to half-rate or full-rate is small.

FIG. 23 illustrates a configuration for pattern modifier 76. Pattern modifier 76 outputs a potentially different encoding mode and encoding rate than the sem and ser. Depending on the fraction (p_fraction) of frames received as an input, this may be done in a number of ways. One way is to use a lookup table (or multiple tables if desired) or any equivalent means, and to determine a priori (i.e., pre-determine) how many frames, K, may change out of F frames, for example, from half rate to full rate, irrespective of encoding mode when a certain fraction is received. In one aspect, the fraction may be used exactly. In such a case, for example, a fraction of ⅓ may indicate a change every 3rd frame. In another aspect, the fraction may also indicate a rounding to the nearest integer frame before changing the encoding rate. For example, a fraction of 0.36 may be rounded to the nearest integer numerator out of 100. This may indicate that every 36th frame out of 100 frames, a change in encoding rate may be made. If the fraction were 0.360, it may indicate that every 360th frame out of 1000 frame may be changed.

Even if the fraction were carried out to more places to the right of the decimal, truncation to fewer places to the right of the decimal may change in which frame the encoding rate may be changed. In another aspect, fractions may be mapped to a set of fractions. For example, 0.36 may be mapped to ⅜ (every K=3 out of F=8 frames a change in encoding rate may be made), and 0.26 may be mapped to ⅕ (every K=1 out of F=5 frames a change in encoding rate may be made). Another way is to use a different lookup table(s) or equivalent means and, in addition to pre-determining in how many frames K out of F (e.g., 1 out of 5, or 3 out of 8) may change from one encoding rate to another, other logic may take into account the encoding mode as well. Yet another way that pattern modifier 76 may output a potentially different encoding mode and encoding rate than the sem and ser is to dynamically determine (i.e., not to pre-determine) in which frame the encoding rate and/or encoding mode may change.

There are a number of dynamic ways that pattern modifier 76 may determine in which frame the encoding rate and/or encoding mode may change. One way is to combine a pre-determined way (for example, one of the ways described above will be illustrated) with a configurable modulo counter. Consider the example of 0.36 being mapped to the pre-determined fraction ⅜. The fraction ⅜ may indicate that a pattern of changing the encoding rate three out of eight frames may be repeated a number of pre-determined times. In a series of eighty frames, for example, there may be a pre-determined decision to repeat the pattern ten times. In other words, out of eighty frames, the encoding rate of thirty of the eighty frames were potentially changed to a different rate. There may be logic to pre-determine in which 3 out of 8 frames the encoding rate will be changed. Thus, the selection of which thirty frames out of eighty in this example is predetermined.

However, there may be a finer resolution, more flexible control and robust way to determine in which frame the encoding rate may change by converting a fraction into an integer and counting the integer with a modulo counter. Since the ratio ⅜ equals the fraction 0.375, the fraction may be scaled to be an integer, for example, 0.375*1000=375. The fraction may also be truncated and then scaled, for example, 0.37*100=37, or 0.3*10=30. In the preceding examples, the fraction was converted into integers, either 375, 37 or 30. As an example, consider using the integer that was derived by using the highest resolution fraction, namely, 0.375 in equation (1). Alternatively, the original fraction, 0.360, could be used as the highest resolution fraction to convert into an integer and used in equation (1). For every active speech frame and desired encoding mode and/or desired encoding rate, the integer in equation (1) may be added by a modulo operation as shown by equation (1) below:

$$\text{patterncount}=\text{patterncount}+\text{integer mod modulo_threshold} \quad (1)$$

where patterncount may initially be equal to zero, and modulo_threshold may be the scaling factor used to scale the fraction.

A generalized form of equation (1) is shown by equation (2). By implementing equation (2), a more flexible control in the number of possible ways to dynamically determine in which frame the encoding rate and/or encoding mode may change may be obtained.

$$\text{patterncount}=(\text{patterncount}+c1*\text{fraction})\text{mod } c2 \quad (2)$$

where c1 may be the scaling factor, fraction may be the p_fraction received by pattern modifier 76 or a fraction may be derived (for example, by truncating p_fraction or some form of rounding of p_fraction) from p_fraction, and c2 may be equal to c1 or may be different than c1.

Pattern modifier 76 may comprise a switch 93 to control when multiplication with multiplier 94 and modulo addition with adder modulo adder 96 occurs. When switch 93 is activated via desired active signal, multiplier 94 multiplies p_fraction (or a variant) by a constant c1 to yield an integer. Modulo adder 96 may add the integer for every active speech frame and desired encoding mode and/or desired encoding rate. The constant c1 may be related to the target rate. For example, if the target rate is on the order of kilo-bits-per-second (kbps), c1 may have the value 1000 (representing 1 kbps). To preserve the number of frames changed by the resolution of p_fraction, c2 may be set to c1. There may be a wide variety of configurations for modulo c2 adder 96, one configuration is illustrated in FIG. 23.

As explained above, the product c1*p_fraction may be added, via adder 100, to a previous value fetched from memory 102, patterncount (pc). Patterncount may initially be any value less than c2, although zero is often used. Patterncount (pc) may be compared to a threshold c2 via threshold comparator 104. If pc exceeds the value of c2, then an enable signal is activated. Rollover logic 106 may subtract off c2 from pc and modify the pc value when the enable signal is activated, i.e., if pc>c2 then rollover logic 106 may implement the following subtraction: pc=pc−c2. The new value of pc, whether updated via adder 100 or updated after rollover logic 106, may then be stored back in memory 102. In some configurations, override checker 108 may also subtract off c2 from pc. Override checker may be optional but may be required when encoding rate/mode overrider 78 is used or overrider 78 is present with dynamic encoding rate/mode determinator 72.

Encoding mode/encoding rate selector 110 may be used to select an encoding mode and encoding rate from an sem and ser. In one configuration, active speech mask bank 112 acts to only let active speech suggested encoding modes and encoding rates through. Memory 114 is used to store current and past sem's and ser's so that last frame checker 116 may retrieve a past sem and past ser and compare it to a current sem and ser. For example, in one aspect, for operating point anchor point two (op_ap2) the last frame checker 116 may determine that the last sem was ppp and the last ser was quarter rate. Thus, the signal sent to encoding rate/encoding mode changer may send a desired suggested encoding mode (dsem) and desired suggested encoding rate (dser) to be changed by encoding rate/mode overrider 78. In other configurations, for example, for operating anchor point zero, a dsem and dser may be unvoiced and quarter-rate, respectively. A person or ordinary skill in the art will recognize that there are multiple ways to implement the functionality of encoding mode/encoding rate selector 110, and will further recognize that the terminology "desired suggested encoding mode" and "desired suggested encoding rate" is used here for convenience. The dsem is an sem and the ser is an ser, however, which sem and ser to change may depend on a particular configuration, which depends in whole or in part on, for example, the operating anchor point.

An example may be used to illustrate the operation of pattern modifier 76. Consider the case for operating anchor point zero (op_ap0) and the following pattern of 20 frames (7u, 3v, 1u, 6v, 3u) uuuuuuuvvvuvvvvvvuuu, where u=unvoiced and v=voiced. Suppose that patterncount (pc) has a value of 0 at the beginning of the 20 frame pattern above, and further suppose that p_fraction is ⅓ and c1 is 1000 and c2 is 1000. The decision to change unvoiced frames to, for example, from quarter rate nelp to full-rate celp during operating anchor point zero would be as follows in Table 1.

Note that the 4th frame, the 7th frame and the 20th frame all changed from quarter-rate nelp to full-rate celp, although the sem was nelp and ser was quarter-rate. In one exemplary aspect, for operating point anchor point zero (op_ap0), patterncount may only be updated for unvoiced speech mode when sem is nelp and ser is quarter rate. During other conditions (for example, speech being voiced), the sem and ser may not be considered to be changed, as indicated by the x and y in the penultimate column of Table 1.

To further illustrate the operation of modifier 76, consider a different case, for operating anchor point one (op_ap1), when there is the following pattern of 20 frames (18v, 1u, 1v) vvvvvvvuuuvvvvvvuuuv, where u=unvoiced and v=voiced. Suppose that patterncount (pc) has a value of 0 at the beginning of the 20 frame pattern above, and further suppose that p_fraction is ⅕ and c1 is 1000 and c2 is 1000. As en example, let the encoding mode for the 20 frames be (ppp, ppp, ppp, celp, celp, celp, celp, ppp, nelp, nelp, nelp, nelp, ppp, ppp, ppp, ppp, ppp, celp, celp, ppp) and the encoding rate be one amongst eighth rate, quarter rate, half rate and full rate. The decision to change voiced frames that have an encoding rate of a quarter rate and an encoding mode of ppp, for example, from quarter rate ppp to full-rate celp during operating anchor point one (op_ap0) would be as follows in Table 2.

TABLE 1

| frame | patterncount (pc) | Equation (1) and rollover logic used to calculate next pc value: if pc > c2, then pc = pc − c2 | encoding rate | encoding mode | speech |
|---|---|---|---|---|---|
| 1 | 333 | 0 + ⅓ * 1000 | quarter-rate | nelp | u |
| 2 | 666 | 333 + 333 | quarter-rate | nelp | u |
| 3 | 999 | 666 + 333 | quarter-rate | nelp | u |
| 4 | 1332 | If 1332 > 1000, 1332 − 1000 = 332 Now apply eq. 1: 332 + 333 | full-rate | celp | u |
| 5 | 665 | 665 + 333 | quarter-rate | nelp | u |
| 6 | 998 | 998 + 333 | quarter-rate | nelp | u |
| 7 | 1031 | If 1031 > 1000, 1031 − 1000 = 31 Now apply eq. 1: 31 + 333 | full-rate | celp | u |
| 8-10 | 364 | In op_ap0, may only update pc for unvoiced speech mode | x | y | v |
| 11 | 364 | 364 + 333 | quarter-rate | nelp | u |
| 12-17 | 697 | In op_ap0, may only update pc for unvoiced speech | x | y | v |
| 18 | 697 | 697 + 333 | quarter-rate | nelp | u |
| 19 | 1000 | 1000 + 333 | quarter-rate | nelp | u |
| 20 | 1333 | If 1333 > 1000, 1333 − 1000 = 333 Now apply eq. 1: 333 + 333 | full-rate | celp | u |

TABLE 2

| frame | patterncount (pc) | equation (1) and rollover logic used to calculate next pc value: if pc > c2, then pc = pc − c2 | encoding rate | encoding mode | sem |
|---|---|---|---|---|---|
| 1 | 250 | 0 + ¼ * 1000 | quarter-rate | pppp | ppp |
| 2 | 500 | 250 + 250 | quarter-rate | pppp | ppp |
| 3 | 750 | 500 + 250 | quarter-rate | ppp | ppp |
| 4-7 | 750 | In op_ap1, may only update pc for voiced quarter-rate ppp | x | y | celp |
| 8 | 750 | In op_ap1, may only update pc for voiced quarter-rate ppp | full-rate | ppp | ppp |
| 9-12 | 750 | In op_ap1, may only update pc for voiced quarter-rate ppp | x | nelp | nelp |
| 13 | 1000 | 750 + 250 | quarter-rate | ppp | ppp |
| 14 | 1000 | In op_ap1, may only update pc for voiced quarter-rate ppp | full-rate | celp | ppp |
| 15 | 1250 | If 1250 > 1000, 1250 − 1000 = 250 Now apply eq. 1: 250 + 250 | full-rate | celp | ppp |

TABLE 2-continued

| frame | patterncount (pc) | equation (1) and rollover logic used to calculate next pc value: if pc > c2, then pc = pc − c2 | encoding rate | encoding mode | sem |
|---|---|---|---|---|---|
| 16 | 500 | In op_ap1, may only update pc for voiced quarter-rate ppp | full-rate | ppp | ppp |
| 17 | 750 | 500 + 250 | quarter-rate | ppp | ppp |
| 18-19 | 1250 | In op_ap1, may only update pc for voiced quarter-rate ppp | full-rate | celp | celp |
| 20 | 1000 | 750 + 250 | quarter-rate | ppp | ppp |

FIG. 24 illustrates a way to change encoding mode and/or encoding rate to a different encoding rate and possibly different encoding mode. Method 120 comprises generating an encoding mode (such as an sem) 124, generating an encoding rate (such as an ser) 126, checking if there is active speech 127, and checking if the encoding rate is less than full 128. In one aspect, if these conditions are met, method 122 decides to change encoding mode and/or encoding rate. After using a fraction of frames to potentially change the encoding mode and/or encoding rate, a patterncount (pc) is generated 130 and checked against a modulo threshold 132. If the pc is less than the modulo threshold, the pc is modulo added to an integer scaled version of p_fraction to yield a new pc 130 and for every active speech frame. If the pc is greater than the modulo threshold, a change of encoding mode and/or encoding rate to a different encoding rate and possibly different encoding mode is performed. A person of ordinary skill in the art will recognize that other variations of method 120 may allow encoding rate equal to full before proceeding to method 122.

FIG. 25 is another exemplary illustration of a way to change encoding mode and/or encoding rate to a different encoding rate and possibly different encoding mode. An exemplary method 120A may determine which sem and ser for different operating anchor points may be used with method 122. In exemplary method 120A, when decision block 136 checking for operating anchor point zero (op_ap0) and decision block 137 checking for not-voiced speech are yes, this may yield unvoiced speech mode (and unspecified sem and ser) (see FIG. 5 for a possible choice) may be used with method 122. Decision blocks 138-141 checking for voiced, sem of pp, ser of quarter-rate, and operating anchor point of 2, yielding yes, yes, yes, and no, respectively, may yield that an sem of pp and ser of quarter-rate for operating anchor point one (op_ap1) may be used with method 122 to change any quarter-rate ppp frame, for example, to a full-rate celp frame. If decision block 142 yields yes, for operating anchor point two (op_ap_2), the last frame is checked to see if it was also a quarter rate ppp frame, and method 122 may be used to change only one of the current quarter-rate ppp frame to a full-rate celp frame. A person of ordinary skill in the art will recognize that other methods used to select an encoding mode and/or encoding rate to be changed, such as method 120A, may be used with a method 122 or variant of method 122.

FIG. 26 is an exemplary illustration of pseudocode 143 that may be used to implement a way to change encoding mode and/or encoding rate depending on operating anchor point, such as the combination of method 120A and method 122.

What is claimed is:

1. A method for achieving an arbitrary capacity for a network, said method comprising accomplishing each of the following acts by a network configured to communicate wirelessly with a set of devices accessing the network:

determining a capacity operating point for the network;

setting a target rate for the set of devices, the target rate being set in accordance with the capacity operating point;

selecting a composite rate from among a set of composite rates, wherein each of the set of composite rates includes a first allocation of frames to a first component rate of the selected composite rate and a second allocation of frames to a second component rate of the selected composite rate;

based on the target rate and the selected composite rate, calculating a reallocation fraction;

instructing at least one of the set of devices to reassign, based on the reallocation fraction, a plurality of frames of a speech signal that are assigned to the first component rate of said selected composite rate to the second component rate of said selected composite rate, wherein the second component rate is different than the first component rate, wherein said selected composite rate includes repeated instances of a sequence of different component rates, and wherein said repeated instances define said first and second allocations of said selected composite rate.

2. A method for encoding frames of a speech signal according to a target rate, said method comprising:

within a device for compressing speech, selecting a composite rate from among a set of composite rates, wherein each of the set of composite rates includes a first allocation of frames to a first component rate of the selected composite rate and a second allocation of frames to a second component rate of the selected composite rate;

within the device for compressing speech, and based on the target rate and the selected composite rate, calculating a reallocation fraction;

within the device for compressing speech, and based on the reallocation fraction and the first allocation of the selected composite rate, reallocating a plurality of frames from the first component rate of the selected composite rate to the second component rate of the selected composite rate, wherein said selected composite rate includes repeated instances of a sequence of different component rates, and wherein said repeated instances define said first and second allocations of said selected composite rate.

3. The method of claim 2, wherein said method comprises, for each among the first allocation of frames:

obtaining a value of a random variable;

evaluating a relation between the obtained value and a threshold based on the reallocation fraction; and according to a result of said evaluating, determining whether the frame is a member of the plurality of frames to be reallocated.

4. The method according to claim 2, wherein said calculating a reallocation fraction is based on a second composite rate, and wherein one among the selected composite rate and the second composite rate is greater than the target rate and the other among the selected composite rate and the second composite rate is less than the target rate.

5. The method of claim 4, wherein the reallocation fraction is calculated according to the expression:

$$f=(r_T-r_i)/(r_j-r_i),$$

wherein $r_T$ is the target rate, $r_i$ is the selected composite rate, $r_j$ is the second composite rate, and $r_i<r_T<r_j$.

6. The method according to claim 4, wherein said second composite rate is one among said set of composite rates.

7. The method according to claim 2, wherein said calculating a reallocation fraction is based on an average rate over a plurality of past frames.

8. The method according to claim 2, wherein said selecting a composite rate is based on the target rate.

9. The method according to claim 2, wherein said sequence is a pattern of different component rates applied to respective consecutive frames, and wherein said reallocating a plurality of frames includes altering at least one instance of the sequence.

10. The method according to claim 2, wherein said method comprises:

encoding the plurality of reallocated frames;

calculating an average rate of a sequence of encoded frames that includes the plurality of reallocated frames; and calculating a second value for the reallocation fraction based on the first and second composite rates, the target rate, and the calculated average rate.

11. The method according to claim 2, wherein said reallocating a plurality of frames includes altering at least one of said repeated instances.

12. The method according to claim 2, wherein each of said plurality of reallocated frames corresponds to a different one of said repeated instances.

13. The method according to claim 2, wherein said sequence is a pattern of the first and second component rates.

14. The method according to claim 2, wherein said reallocating comprises reassigning each of said plurality of frames from a prototype pitch period coding mode to a code-excited linear predictive coding mode.

15. A computer-readable non-transitory storage medium comprising:

code for causing at least one computer to select a composite rate from among a set of composite rates, wherein each of the set of composite rates includes a first allocation of frames of a speech signal to a first component rate of the selected composite rate and a second allocation of frames of the speech signal to a second component rate of the selected composite rate;

code for causing at least one computer to calculate a reallocation fraction based on the target rate and the selected composite rate;

code for causing at least one computer to reallocate, based on the reallocation fraction and the first allocation of the selected composite rate, frames from the first component rate of the selected composite rate to the second component rate of the selected composite rate, wherein said selected composite rate includes repeated instances of a sequence of different component rates, and wherein said repeated instances define said first and second allocations of said selected composite rate.

16. An apparatus for encoding frames of a speech signal according to a target rate, said apparatus comprising:

a rate selector configured to select a composite rate from among a set of composite rates, wherein each of the set of composite rates includes a first allocation of frames to a first component rate of the selected composite rate and a second allocation of frames to a second component rate of the selected composite rate;

a calculator configured to calculate a reallocation fraction based on the target rate and the selected composite rate; and a frame reassignment module configured to reassign, based on the reallocation fraction and the first allocation of the selected composite rate, frames from the first component rate of the selected composite rate to the second component rate of the selected composite rat;

wherein the selected composite rate includes a pattern of different component rates applied to respective consecutive frames, and wherein said frame reassignment module is a pattern modifier configured to reassign frames by altering at least one instance of said pattern.

17. The apparatus according to claim 16, wherein said rate selector is configured to select the composite rate based on the target rate.

18. The apparatus according to claim 16, wherein said apparatus comprises a capacity operating point tuner including said rate selector and said calculator.

19. The apparatus according to claim 16, wherein said calculator is configured to calculate the reallocation fraction based on an average rate over a plurality of past frames.

20. The apparatus according to claim 16, wherein said frame reassignment module includes a modulo counter, wherein the frame reassignment module is configured to change a count of the modulo counter using a value based on the reallocation fraction, and wherein, for each of a plurality of frames, the frame reassignment module is configured to decide whether to reassign the frame based on a rollover of the modulo counter.

21. The apparatus according to claim 16, wherein said apparatus comprises:

a speech encoder configured to encode the reassigned frames at the second component rate; and circuitry configured to transmit the encoded frames to a network for cellular radio-frequency communications.

22. The apparatus according to claim 16, wherein said calculator is configured to calculate the reallocation fraction based on a second composite rate, and wherein one among the selected composite rate and the second composite rate is greater than the target rate and the other among the selected composite rate and the second composite rate is less than the target rate.

23. The apparatus according to claim 16, wherein said frame reassignment module is configured to reassign said frames from the first component rate of the selected composite rate to the second component rate of the selected composite rate by altering at least one of said repeated instances.

24. The apparatus according to claim 16, wherein each of said plurality of reassigned frames corresponds to a different one of said repeated instances.

25. An apparatus for encoding frames of a speech signal according to a target rate, said apparatus comprising:

means for selecting a composite rate from among a set of composite rates, wherein each of the set of composite rates includes a first allocation of frames to a first component rate of the selected composite rate and a second allocation of frames to a second component rate of the selected composite rate;

means for calculating a reallocation fraction based on the target rate and the selected composite rate; and means for reallocating a plurality of frames from the first component rate of the selected composite rate to the second component rate of the selected composite rate, based on the reallocation fraction and the first allocation of the selected composite rate, wherein said selected composite rate includes repeated instances of a pattern of the first and second component rates, and wherein said repeated instances define said first and second allocations of said selected composite rate.

26. The apparatus according to claim 25, wherein each of said plurality of reallocated frames corresponds to a different one of said repeated instances, and wherein said means for reallocating a plurality of frames is configured to alter, for each of said plurality of frames, said corresponding repeated instance, and wherein said means for reallocating is configured to reassign each of said plurality of frames from a prototype pitch period coding mode to a code-excited linear predictive coding mode.

* * * * *